US011713936B1

(12) United States Patent
Lowell et al.

(10) Patent No.: US 11,713,936 B1
(45) Date of Patent: Aug. 1, 2023

(54) FIXED-TO-TILTED SILENCER ADAPTOR FOR THREE-LUG ATTACHMENTS

(71) Applicant: Lirces 3, Macungie, PA (US)

(72) Inventors: Seth Alan Lowell, Macungie, PA (US); Daniel Reader, Charlotte, NC (US)

(73) Assignee: LIRCES 3, Macungie, PA (US)

( * ) Notice: Subject to any disclaimer, the term of this patent is extended or adjusted under 35 U.S.C. 154(b) by 47 days.

(21) Appl. No.: 17/676,429

(22) Filed: Feb. 21, 2022

(51) Int. Cl.
*F41A 21/36* (2006.01)
*F41A 21/30* (2006.01)
*F41A 21/32* (2006.01)

(52) U.S. Cl.
CPC ..... *F41A 21/36* (2013.01); *F41A 21/30* (2013.01); *F41A 21/325* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS

| | | | | |
|---|---|---|---|---|
| 5,136,924 | A | 8/1992 | Forster | |
| 5,559,302 | A | 9/1996 | Latka | |
| 5,685,102 | A * | 11/1997 | Latka | F41A 21/325 89/14.05 |
| 2016/0102935 | A1* | 4/2016 | Young | F41A 21/325 42/76.01 |
| 2017/0167816 | A1* | 6/2017 | Young | F41A 21/325 |
| 2018/0106569 | A1* | 4/2018 | Smith | F41A 21/30 |

OTHER PUBLICATIONS

TFB Review: Griffin Armament CAM-LOK—One Can, Multiple Caliber Hosts, Retrieved from Internet, Retrieved on Dec. 20, 2021 <URL: https://www.thefirearmblog.com/blog/2020/12/15/tfb-review-griffin-armament-cam-lok/>.

Optimus Silencer 1, Retrieved from Internet, Retrieved on Dec. 20, 2021 <URL: https://www.reconbyfirellc.com/Optimus-Silencer-1_p_1148.html>.

Rugged Suppressors 9mm Luger 3 Lug Barrel Adapter ½×28 Black. Retrieved from Internet, Retrieved on Dec. 20, 2021 <URL: https://www.cheaperthandirt.com/rugged-suppressors-9mm-luger-3-lug-barrel-adapter-12x28-black/FC-859383006709.html>.

* cited by examiner

*Primary Examiner* — Joshua E Freeman
*Assistant Examiner* — Benjamin S Gomberg

(57) ABSTRACT

A fixed-to-tilted silencer adaptor for three-lug attachments enables the use of tilting barrel gun silencers or fixed non-moving barrel gun silencers with different guns of the same caliber. The present invention enables users to utilize a gun silencer with the desired gun even if the gun silencer does not match the design of the gun. To do so, the present invention may comprise a recoil booster and a three-lug adaptor. The recoil booster is designed to accommodate the movement of a tilting barrel while facilitating the connection between the gun silencer and the gun's barrel. The recoil booster also securely receives the three-lug adaptor to facilitate the quick attachment of the recoil booster to the gun's barrel. The three-lug adaptor is designed to enable the quick attachment of the recoil booster to the gun's barrel without interfering with the movement of the gun's barrel when connected to a tilted barrel.

20 Claims, 34 Drawing Sheets

FIXED-TO-TILTED SILENCER ADAPTOR FOR THREE-LUG ATTACHMENTS

FIELD OF THE INVENTION

The present invention relates generally to guns and gun accessories. More specifically, the present invention provides a silencer adaptor designed to accommodate both gun silencers that require recoil boosters and gun silencers that do not require recoil boosters.

BACKGROUND OF THE INVENTION

Gun silencers are popular gun accessories that in general come in two distinct designs: tilting barrel design and fixed non-moving barrel design. The tilting barrel design is manufactured so that the gun silencer can accommodate the movement of the gun's barrel by using a recoil booster. For example, in a Glock-style 9-millimeter (mm) handgun as the gun fires, the barrel tilts up and back which helps the slide move backwards and chamber the next round more reliably. If the Glock's threaded barrel is simply screwed into a solid body silencer, the barrel pulls the silencer into the lower receiver of the Glock that supports the barrel and stops the action, causing a malfunction known as failure to feed which means the next round is not loaded and able to fire. This problem was solved by utilizing a recoil booster/Nielsen device that attaches in between the silencer and threaded barrel. A threaded piston that is held in place under spring tension connects to the barrel in the recoil booster. The piston can be pulled out of the recoil booster main body assembly and travel with the tilting barrel when the gun is fired, which allows perfect functioning of the gun in feeding the next round and ejecting the spent case.

On the other hand, the fixed non-moving barrel design is manufactured to be directly connected to the end of the gun's non-moving barrel. For example, the barrels of rifles and revolvers do not move when fired, which eliminates the need of a recoil booster. In this case, the gun silencer can be made with a solid non-moving end cap that is threaded to attach to the silencer body. There is no movement of the barrel so the gun silencer can be threaded snugly to the gun barrel via threads as the action of loading the next round is not dependent on barrel tilting like modern handguns.

Further, there are different connection methods for both designs. For example, the direct thread method is a secure way to attach the gun silencer but takes time and precision to align the threads correctly, which can be difficult during combat. This method can be used for both fixed and tilted barrels. Another method is by using a three-lug attachment. The three-lug adaptor is screwed onto the fixed barrel of a weapon. The silencer has a special spring tension three-lug device that allows for the attachment of the three-lug adaptor connected onto the gun barrel to be pushed into the device under tension, and then rotated and locked in place for a rapid and secure fit that takes mere seconds. However, this method can generally only be used on fixed barrels. Another method involves the use of a Cam Lok™. This is another threaded option but is much faster than traditional threaded barrels. Unfortunately, this method can be used with pistol calibers only. Another method involves the user of taper mounts where recoil devices are threaded so that the silencer can attach over the recoil device. This method can be used with fixed barrels only. Further, another method is the use of a Gate Lok™, which is a way the silencer attaches to a recoil device with slots or grooves cut into it. This method is used with fixed barrels only.

Unfortunately, even though there are different gun silencer designs and connection methods available, there is no existing device or connection means that allow for the use of a gun silencer in different guns. For example, if a user with a 9 mm sub-gun like an H&K MPS had to transition to a 9 mm tilting barrel handgun, the user could not use the same silencer since the silencer would cause the 9 mm tilting barrel handgun to jam after a single shot. Further, a H&K MPS or B&T APC 9k uses a three-lug attachment for rapid attachment as does all high-quality sub guns. To make the silencer useful, the user would have to remove the three-lug attachment from the barrel, attach an external booster to the silencer, and then thread the barrel into the booster. All this process takes time that may not be available. Therefore, there is a need for a portable mechanism that allows the use of a gun silencer between guns of the same caliber regardless of the gun silencer design.

SUMMARY OF THE INVENTION

The present invention provides a fixed-to-tilted silencer adaptor for three-lug attachments that enables gun silencers of different designs to be used with different guns of the same caliber. The present invention solves the shortcomings of the prior art by enabling the use of a three-lug adaptor on a tilting barrel gun and/or a fixed barrel gun to allow for seamless transitions of silencers between guns of all kinds that use the same or smaller caliber. To do so, the present invention is attached to the desired gun silencer by threading into the gun silencer in a variety of ways. The present invention also includes a unique three-lug adaptor that attaches onto the barrel of the gun. The present invention has a spring-loaded section that accepts the gun barrel with the three-lug adaptor. The three-lug adaptor is pressed into the present invention against spring tension and rotated into a cut out designed to trap the three-lug adaptor securely in place. Further, the present invention includes a lock mechanism to lock the three-lug adaptor in place so that the three-lug adaptor does not wiggle free during firing. This is where the unique three-lug adaptor comes into play; a relief section for the lock mechanism is cut into the three-lug adaptor to allow a firm connection. Furthermore, the present invention includes a newly designed recoil booster built around the three-lug attachment which allows the three-lug attachment section to travel out of the present invention and move freely with the barrel as the barrel moves when fired from a tilting barrel weapon. Additional features and benefits of the present invention are further discussed in the sections below.

DETAIL DESCRIPTIONS OF THE INVENTION

All illustrations of the drawings are for the purpose of describing selected versions of the present invention and are not intended to limit the scope of the present invention.

Figure 1:
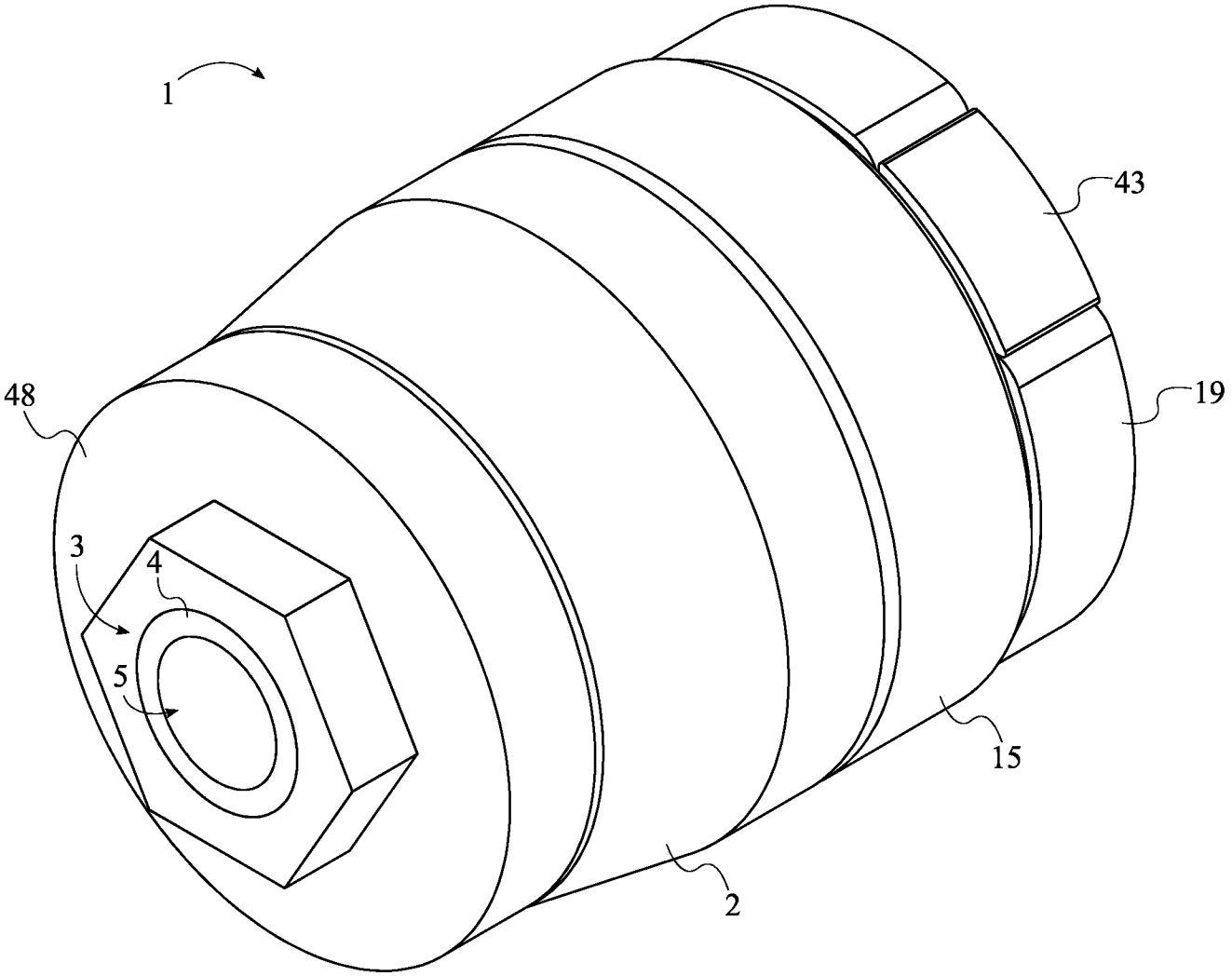
FIG. 1 is a top front perspective view of the present invention.
Figure 2:
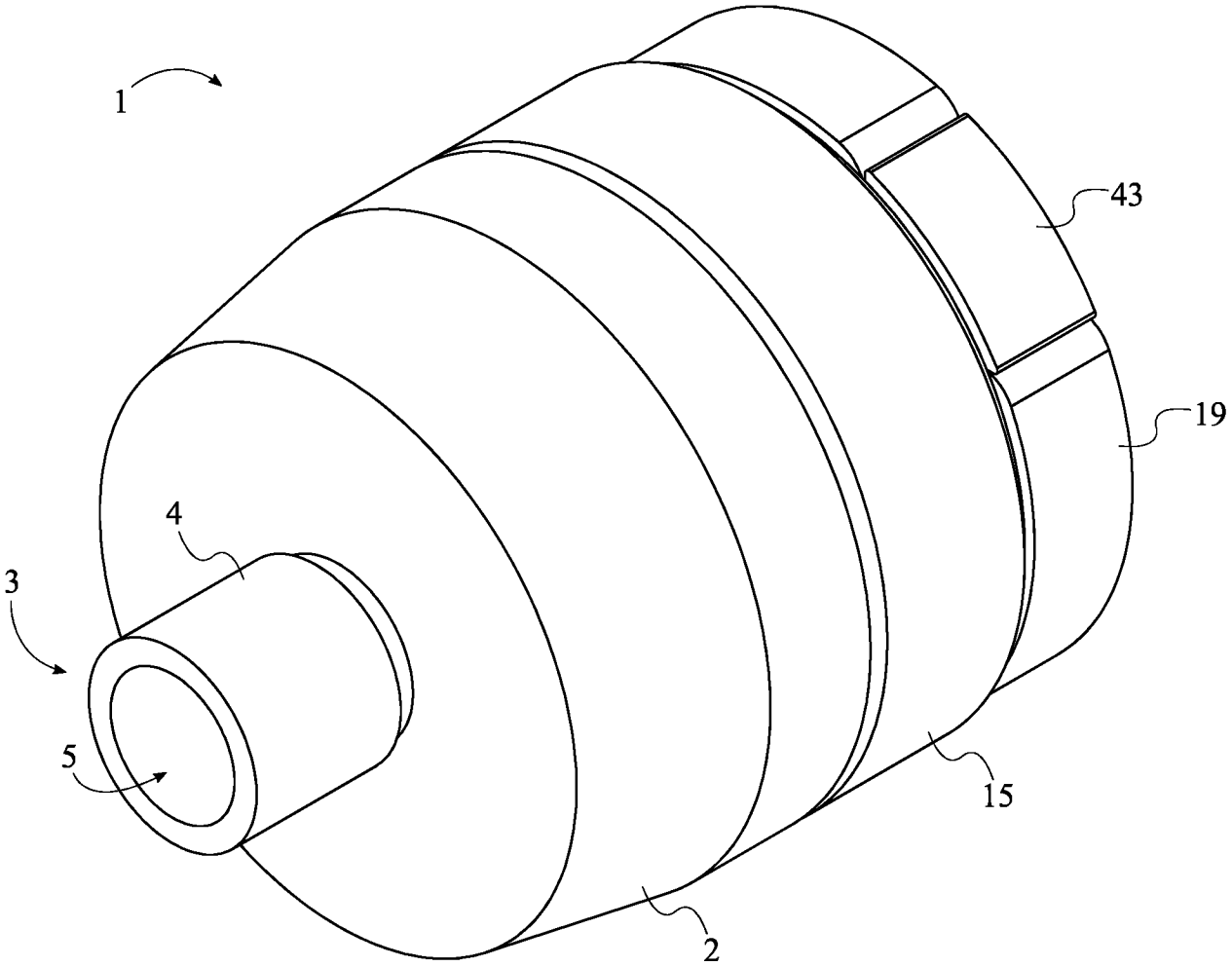
FIG. 2 is a top front perspective view of the present invention, wherein the thread adaptor is shown removed from the recoil housing.
Figure 3:
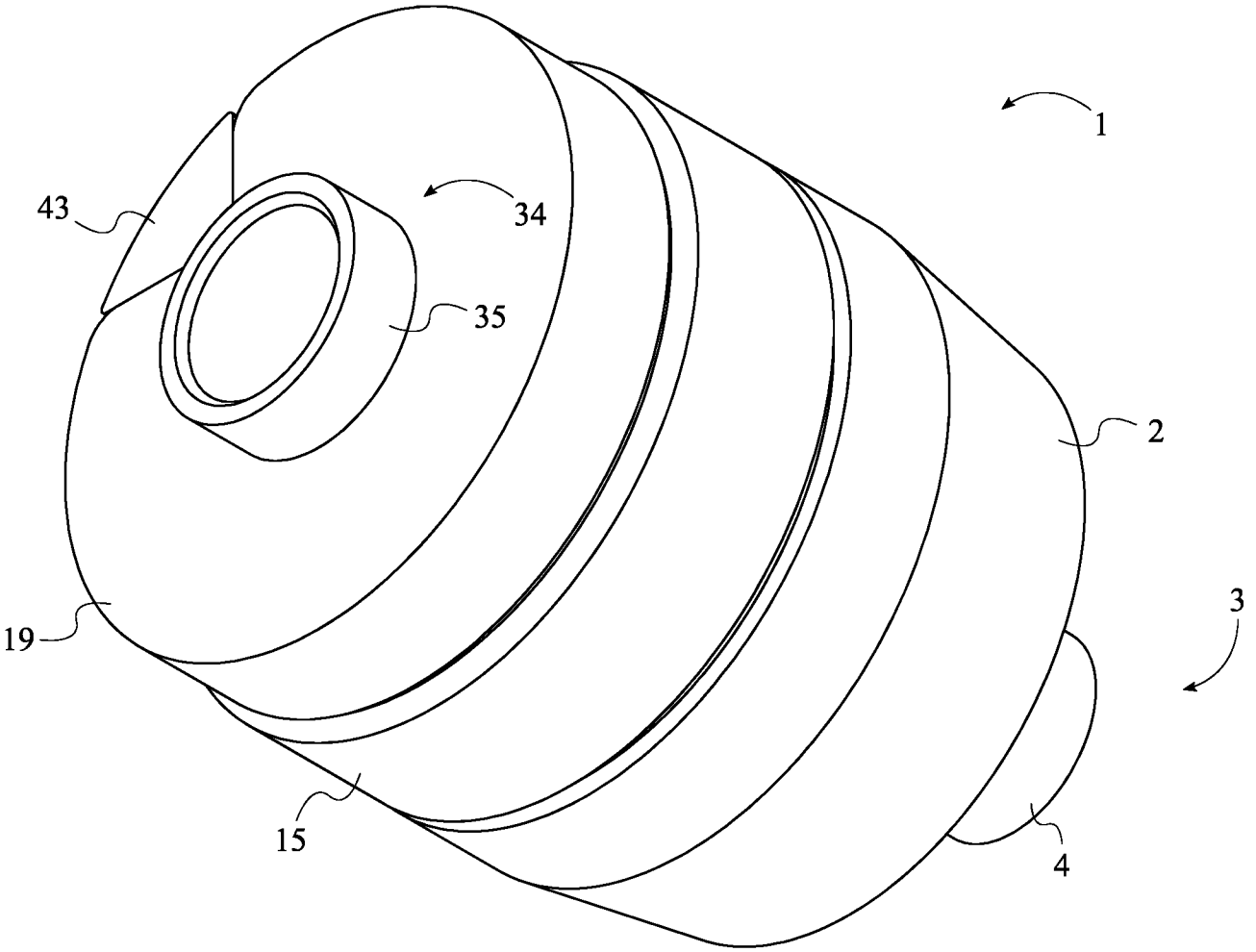
FIG. 3 is a bottom rear perspective view of the present invention, wherein the thread adaptor is shown removed from the recoil housing.
Figure 4:
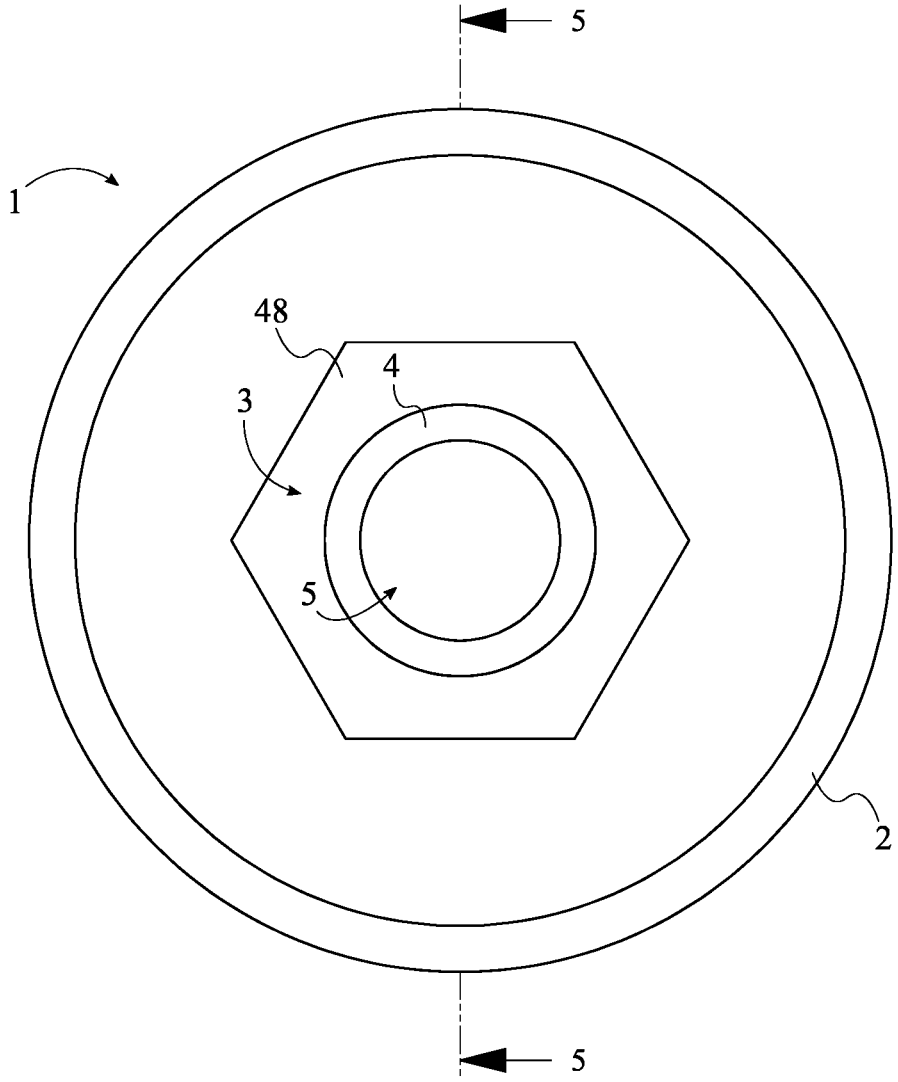
FIG. 4 is a front view of the present invention.
Figure 5:
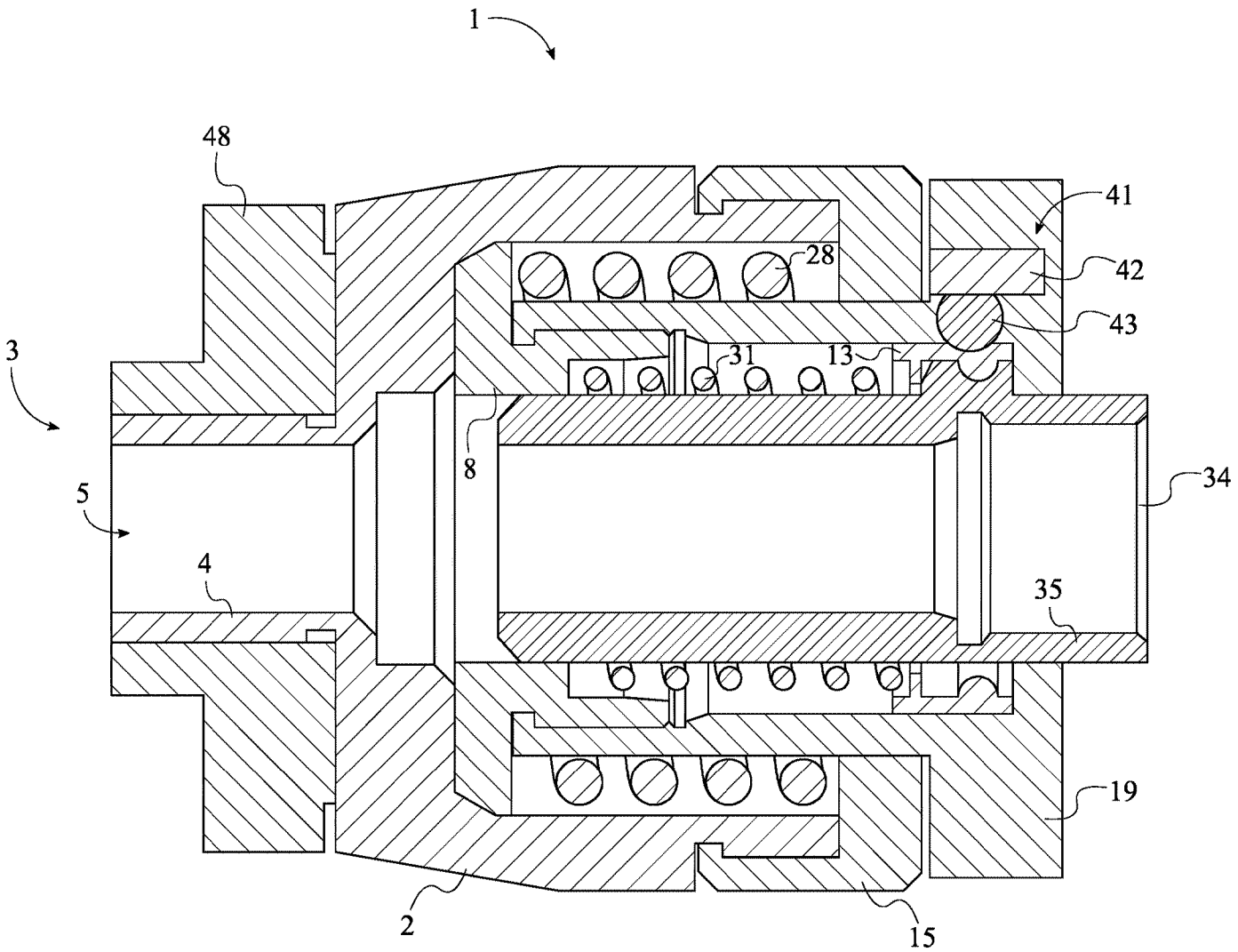
FIG. 5 is a vertical cross-sectional view taken in the direction of line 5-5 in FIG. 4.
Figure 6:
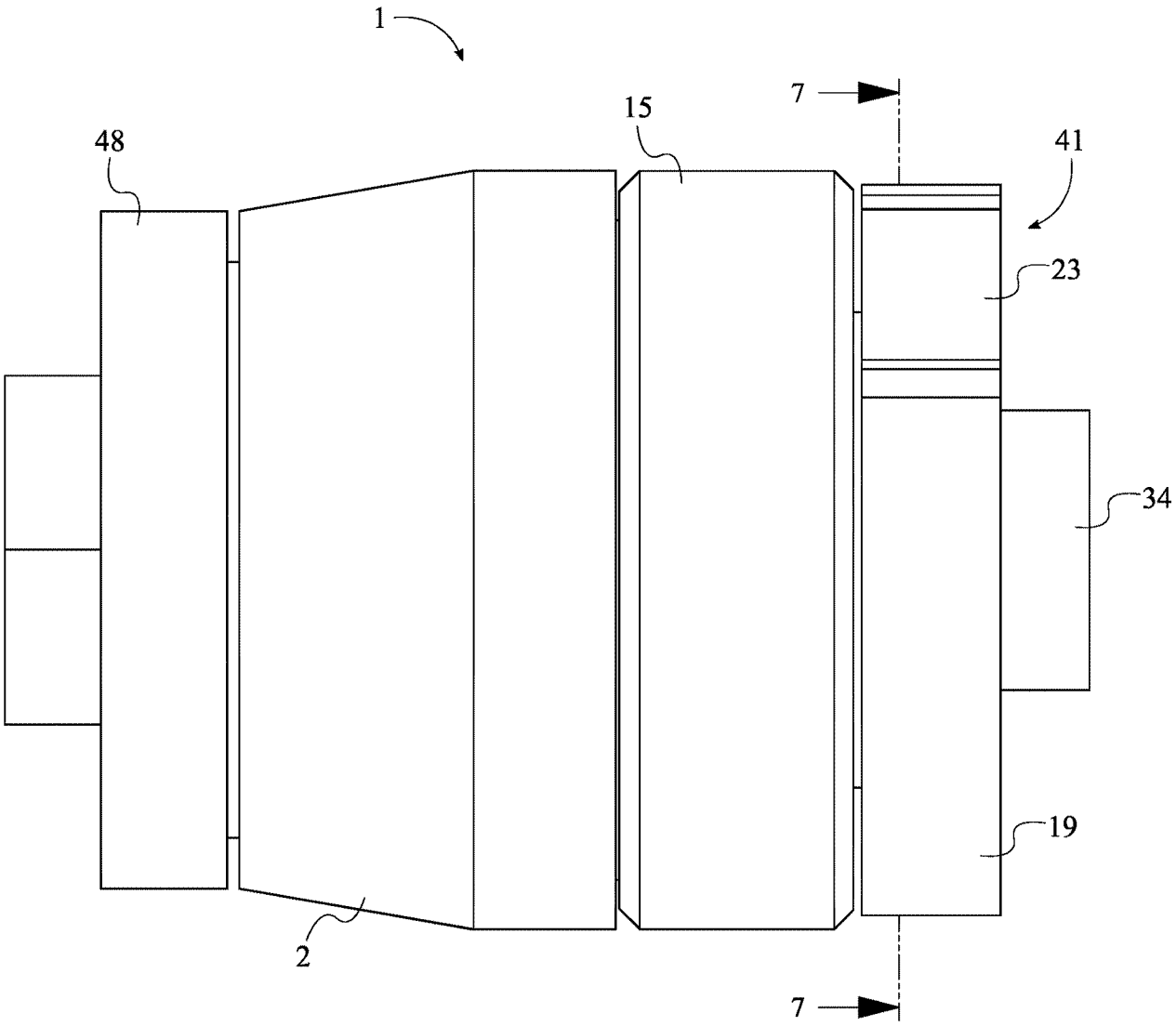
FIG. 6 is a side view of the present invention.
Figure 7:
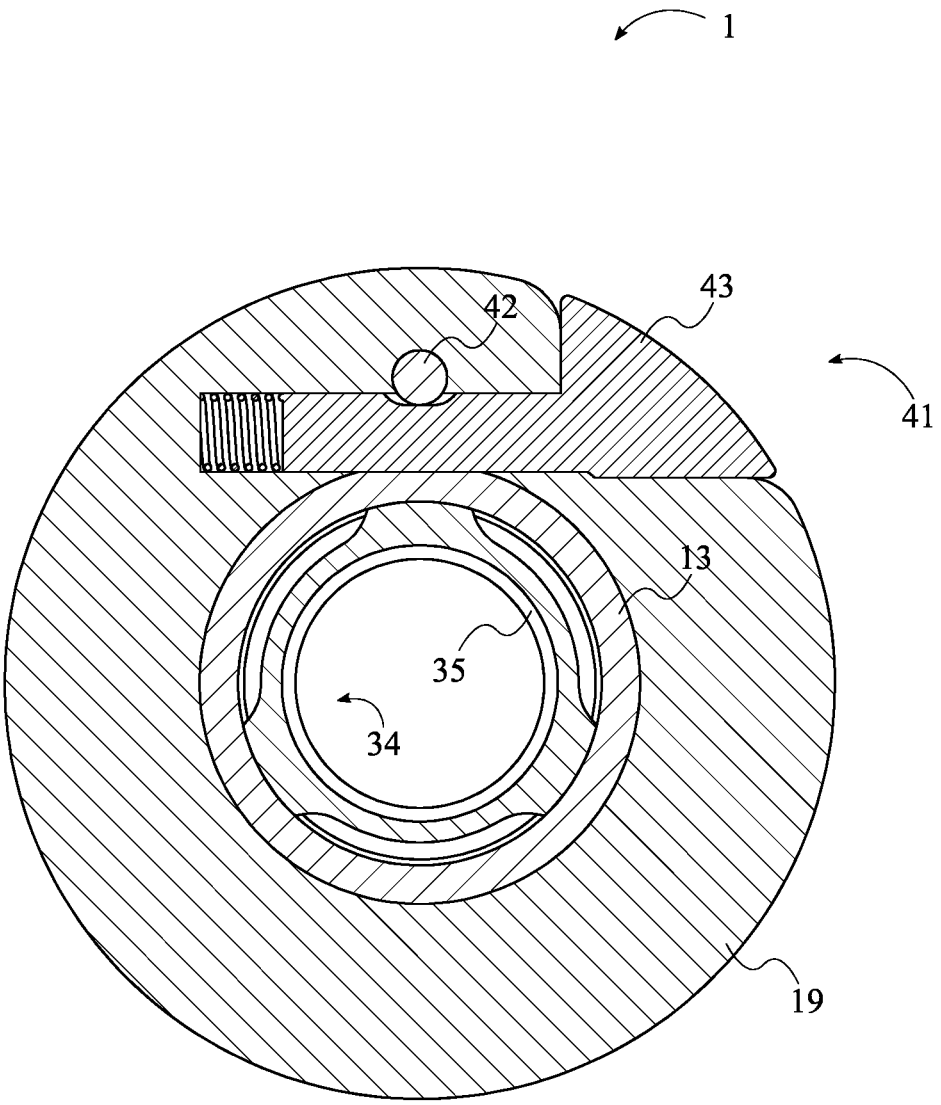
FIG. 7 is a vertical cross-sectional view taken in the direction of line 7-7 in FIG. 6.
Figure 8:
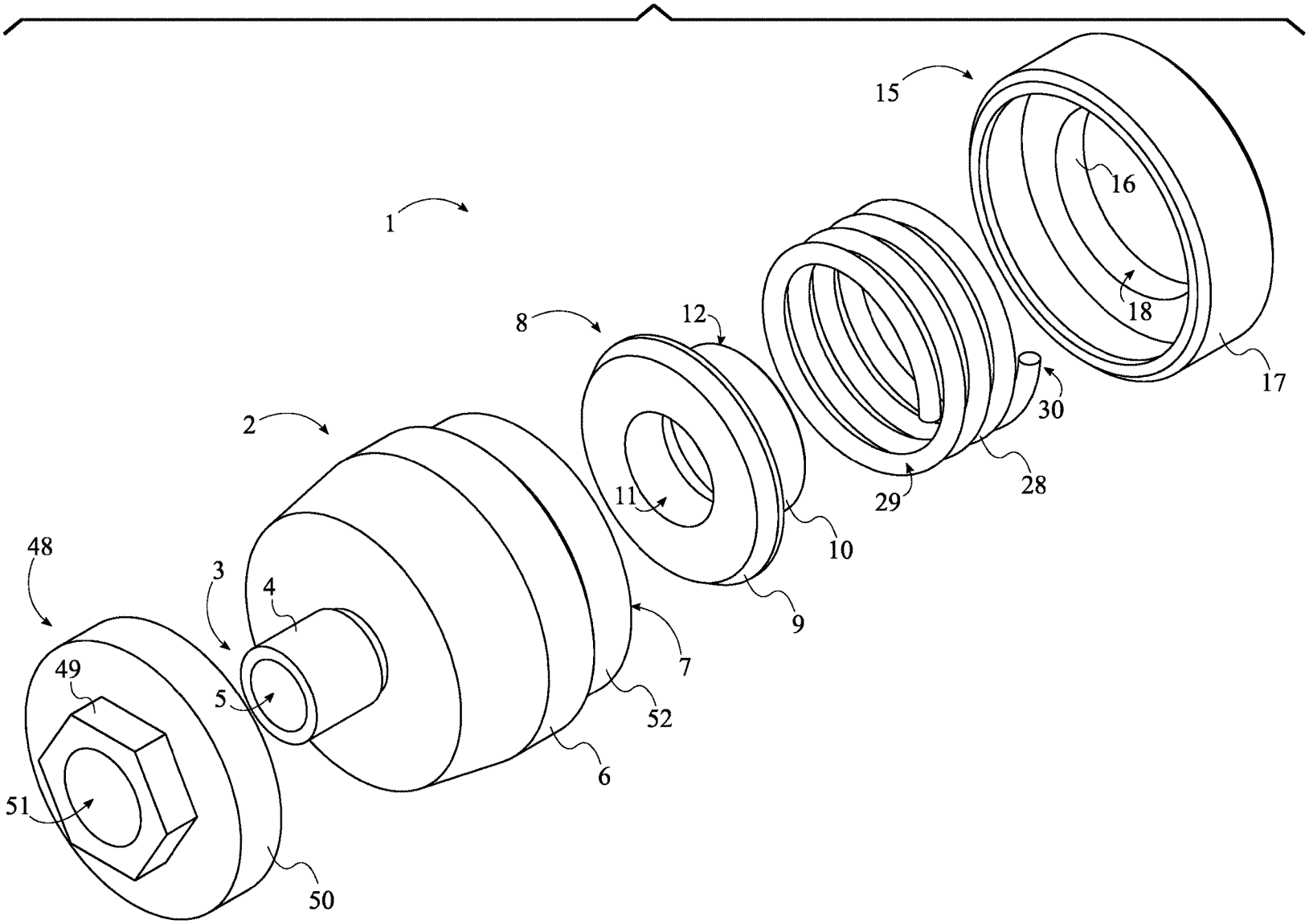
FIG. 8 is a top front exploded perspective view of the present invention, showing the thread adaptor, the recoil housing, the flange adaptor, the first spring, and the open cap.
Figure 9:
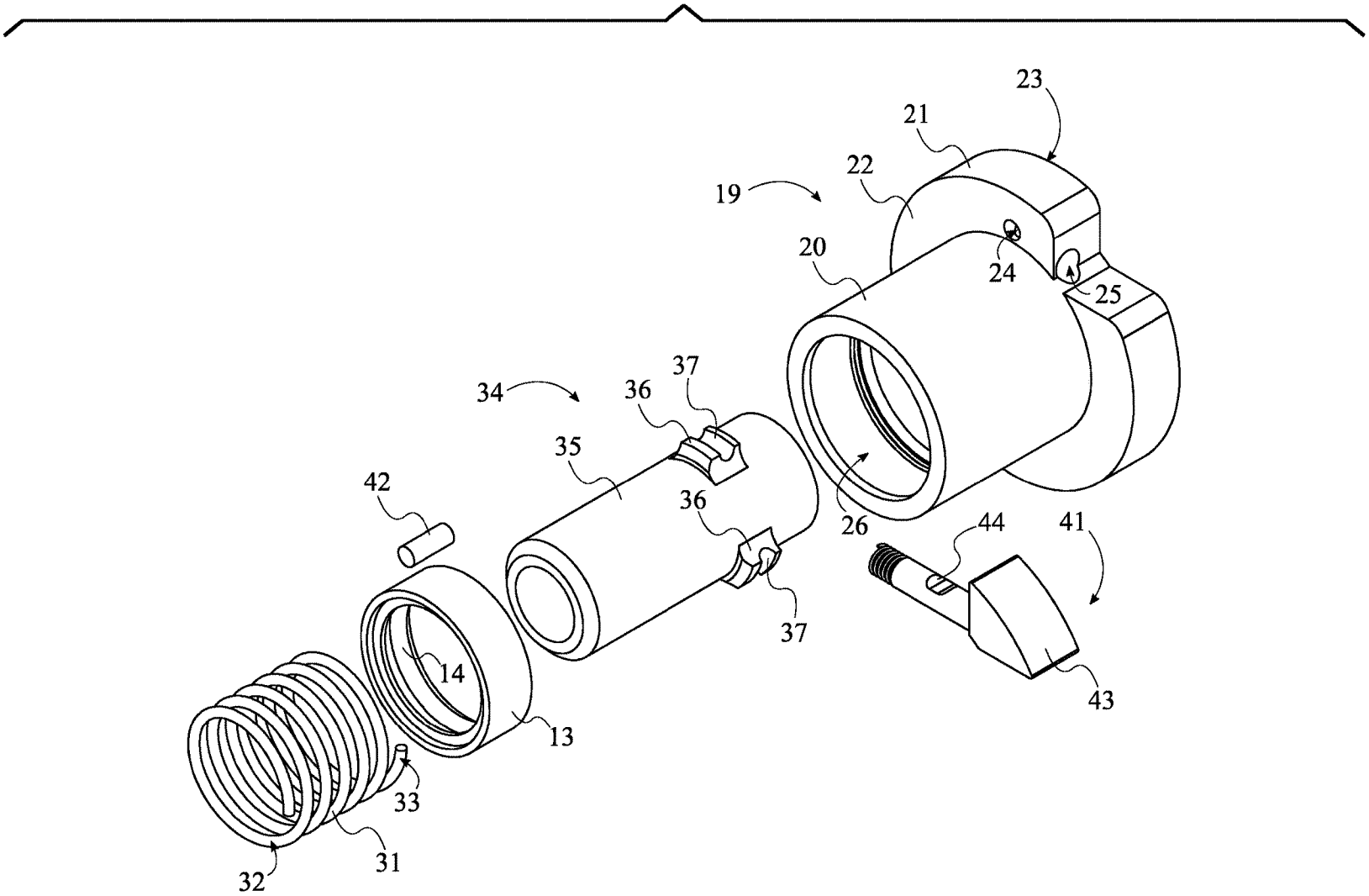
FIG. 9 is a top front exploded perspective view of the present invention, showing the second spring, the coupling, the three-lug adaptor, the lock pin, the spring-loaded pin, and the knobbed bushing.

The present invention is a fixed-to-tilted silencer adaptor for three-lug attachments that enables the use of tilting barrel gun silencers or fixed non-moving barrel gun silencers with different guns of the same caliber. As can be seen in FIG. 1 through 9, the present invention enables users to utilize a gun silencer with any desired gun of the same caliber even if the gun silencer does not match the design of the gun. To do so, the present invention may comprise a recoil booster 1 and a three-lug adaptor 34. The recoil booster 1 is designed to accommodate the movement of a tilting barrel while facilitating the connection between the gun silencer and the gun's barrel. The recoil booster 1 also securely receives the three-lug adaptor 34 to facilitate the quick attachment of the recoil booster 1 to the gun's barrel. The three-lug adaptor 34 is designed to enable the quick attachment of the recoil booster 1 to the gun's barrel without interfering with the movement of the gun's barrel.

Figure 12:
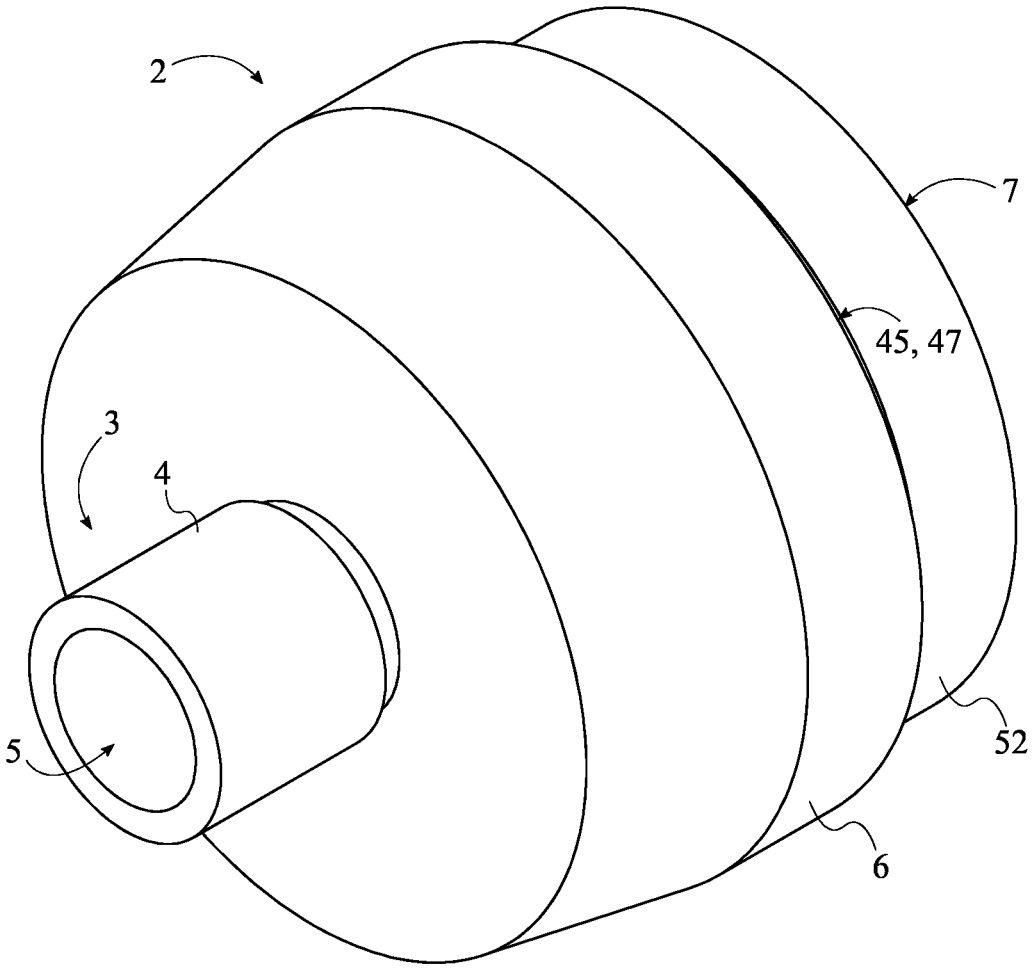
FIG. 12 is a top front perspective view of the recoil housing of the present invention.
Figure 13:
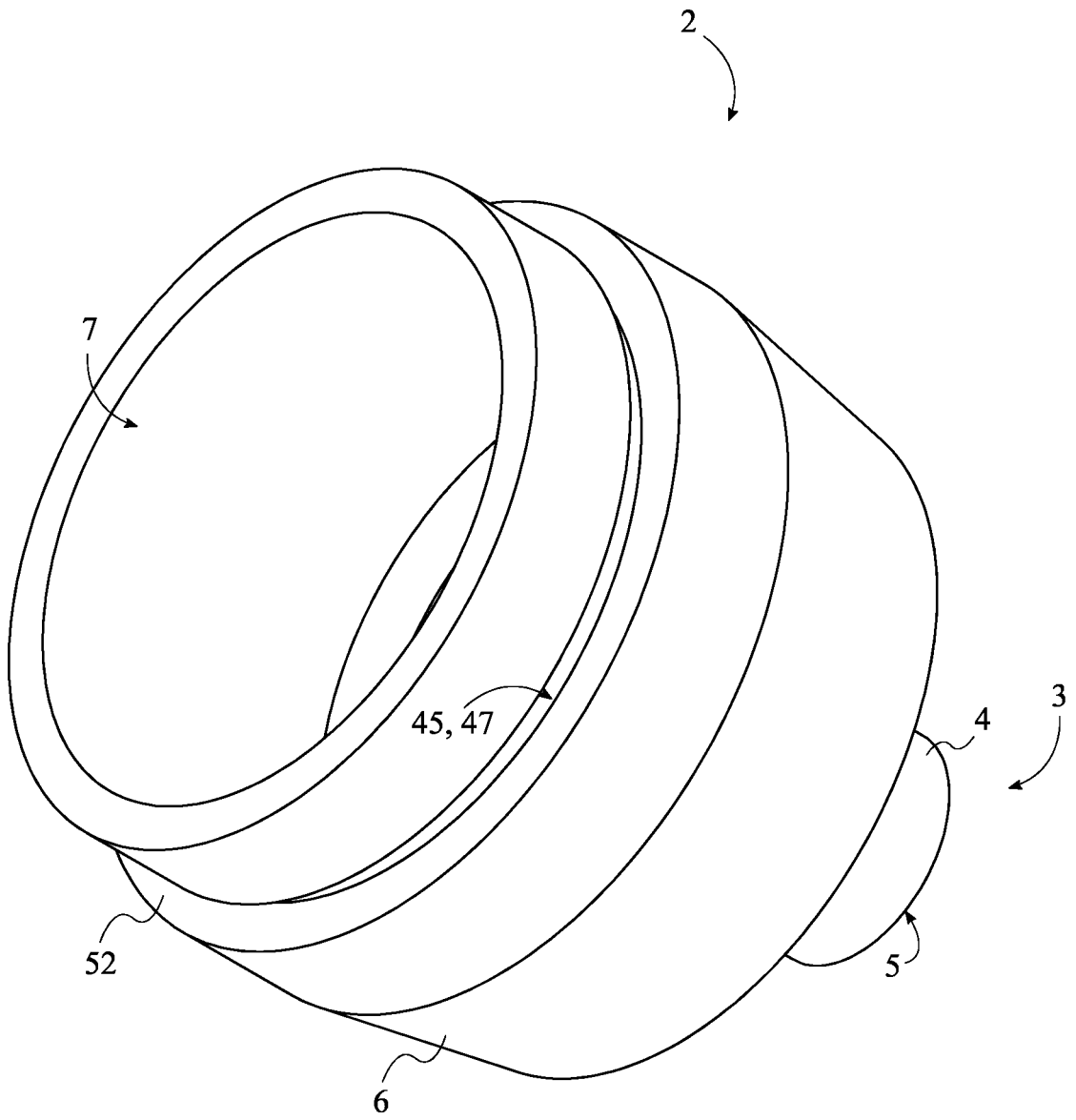
FIG. 13 is a bottom rear perspective view of the recoil housing of the present invention.
Figure 14:
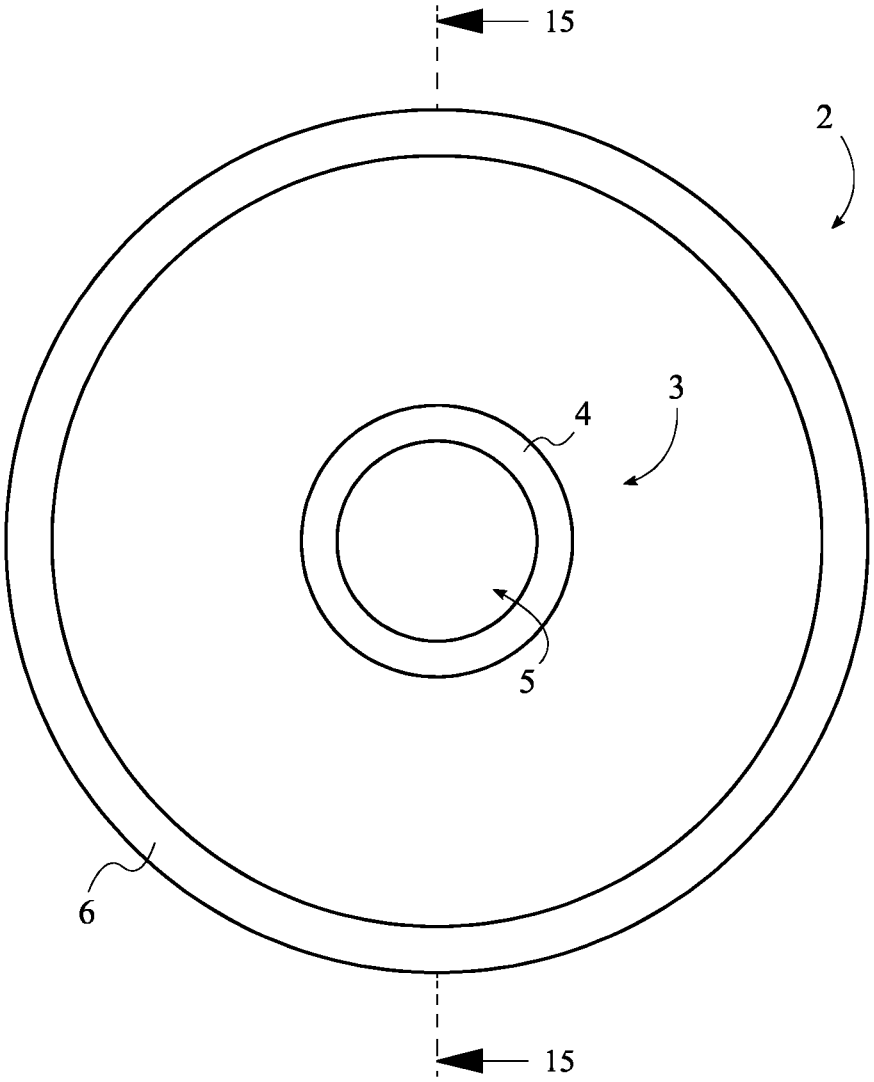
FIG. 14 is a front view of the recoil housing of the present invention.
Figure 15:
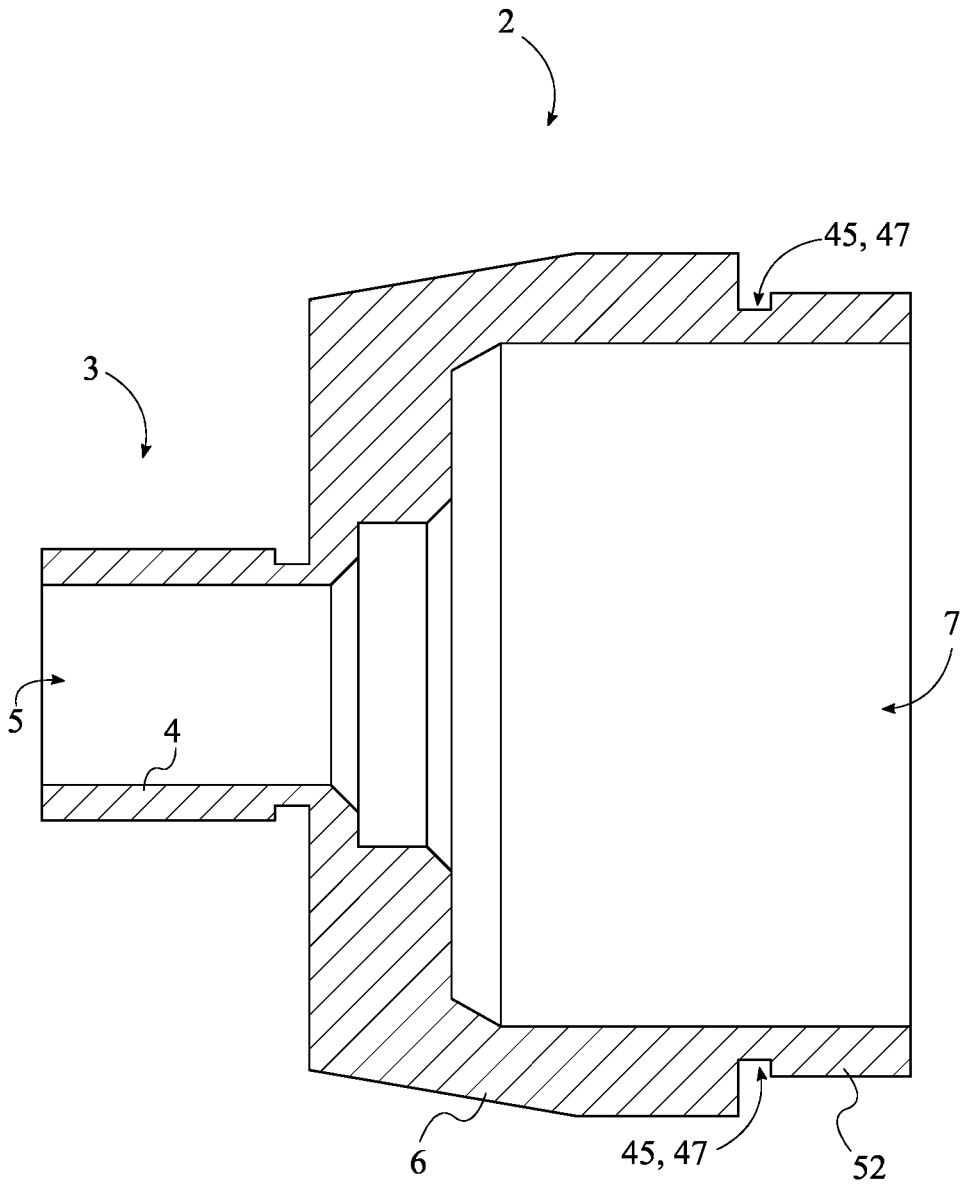
FIG. 15 is a vertical cross-sectional view taken in the direction of line 15-15 in FIG. 14.

The general configuration of the aforementioned components enables the user to quickly switch guns while using the same gun silencer, even if one gun has a tilting barrel design and the other gun has a fixed non-moving barrel design. As can be seen in FIGS. 1 through 9 and 12 through 15, to do so, the recoil booster 1 comprises a recoil housing 2, a flange adaptor 8, a coupling 13, an open cap 15, a knobbed bushing 19, a first spring 28, and a second spring 31. The recoil housing 2 is an overall cylindrical housing designed to retain all moving components in place. The flange adaptor 8, the coupling 13, the knobbed bushing 19, the first spring 28, and the second spring 31 are designed to accommodate the movement a tilting barrel to avoid failure to feed. The open cap 15 helps keep the moving components within the recoil housing 2. Further, the recoil housing 2 is designed to receive the end of a gun silencer. To do so, the recoil housing 2 comprises a threaded protrusion 3, a housing lateral wall 6, and a housing opening 7. The threaded protrusion 3 enables the fastening of the gun silencer to the recoil housing 2 using different threads. The housing lateral wall 6 provides lateral support to the moving components within the recoil housing 2. Further, the housing opening 7 enables the insertion of the moving components into the recoil housing 2.

As can be seen in FIGS. 1 through 9 and 12 through 15, to assemble the recoil booster 1, the threaded protrusion 3 is positioned opposite to the housing opening 7 across the housing lateral wall 6. This enables the gun silencer to be externally attached to the recoil housing 2 without interfering with the operation of the recoil booster 1. The flange adaptor 8, the coupling 13, the open cap 15, the knobbed bushing 19, the first spring 28, the second spring 31, and the three-lug adaptor 34 each are axially aligned with the recoil housing 2. The orientation of each of these components enables the formation of an overall cylindrical structure, with each of the components sharing the same cylindrical axis. Moreover, the flange adaptor 8 is mounted within the recoil housing 2, adjacent to the threaded protrusion 3, to receive the knobbed bushing 19. The first spring 28 is positioned in between the flange adaptor 8 and the housing lateral wall 6 to enable the movement of the flange adaptor 8 within the recoil housing 2. The first spring 28 ensures that the flange adaptor 8 returns to the original position after moving. To do so, the first spring 28 is mounted within the recoil housing 2. In addition, the open cap 15 is terminally connected to the housing opening 7 to keep the first spring 28 within the recoil housing 2 when the flange adaptor 8 is moving. The open cap 15 serves as a stopper that forces the first spring 28 to compress as the flange adaptor 8 moves towards the open cap 15. The flange adaptor 8 is then moved back into the recoil housing 2 as the first spring 28 is released. The open cap 15 ensures the first spring 28 expands into the recoil housing 2, thus pushing the flange adaptor 8 back into the recoil housing 2.

As can be seen in FIGS. 1 through 9 and 12 through 15, to receive the three-lug adaptor 34, the coupling 13 is mounted within the knobbed bushing 19. The coupling 13 is designed to receive the three-lug adaptor 34 in a quick and secure manner without the risk of the three-lug adaptor 34 coming loose when the gun is fired. Further, the second spring 31 is mounted within the knobbed bushing 19, adjacent to the coupling 13, to facilitate the attachment of the three-lug adaptor 34 to the knobbed bushing 19. Moreover, to connect the knobbed bushing 19 to the recoil housing 2, the knobbed bushing 19 traverses into the first spring 28 through the open cap 15 until the knobbed bushing 19 engages with the flange adaptor 8. Finally, to connect the three-lug adaptor 34 to the recoil housing 2, the user inserts the three-lug adaptor 34 into the recoil housing 2 through the knobbed bushing 19. The three-lug adaptor 34 traverses into the flange adaptor 8 through the knobbed bushing 19, the coupling 13, and the second spring 31. Further, as the three-lug adaptor 34 pushes through the coupling 13, the second spring 31 pushes the coupling 13 against the three-lug adaptor 34 until the coupling 13 securely connects with the three-lug adaptor 34. This way, when the present invention is connected to a tilted barrel, the three-lug adaptor 34 can freely move along with the barrel when the gun is fired. As the barrel tilts back and pulls the three-lug adaptor 34, the knobbed bushing 19 is pulled as well, which pulls flange adaptor 8 in return. The flange adaptor 8 compresses the first spring 28 as the flange adaptor 8 is pulled towards the open cap 15. Then, once the projectile has been fired, the first spring 28 helps the flange adaptor 8 move to the original position along with the knobbed bushing 19 and the three-lug adaptor 34.

Figure 16:
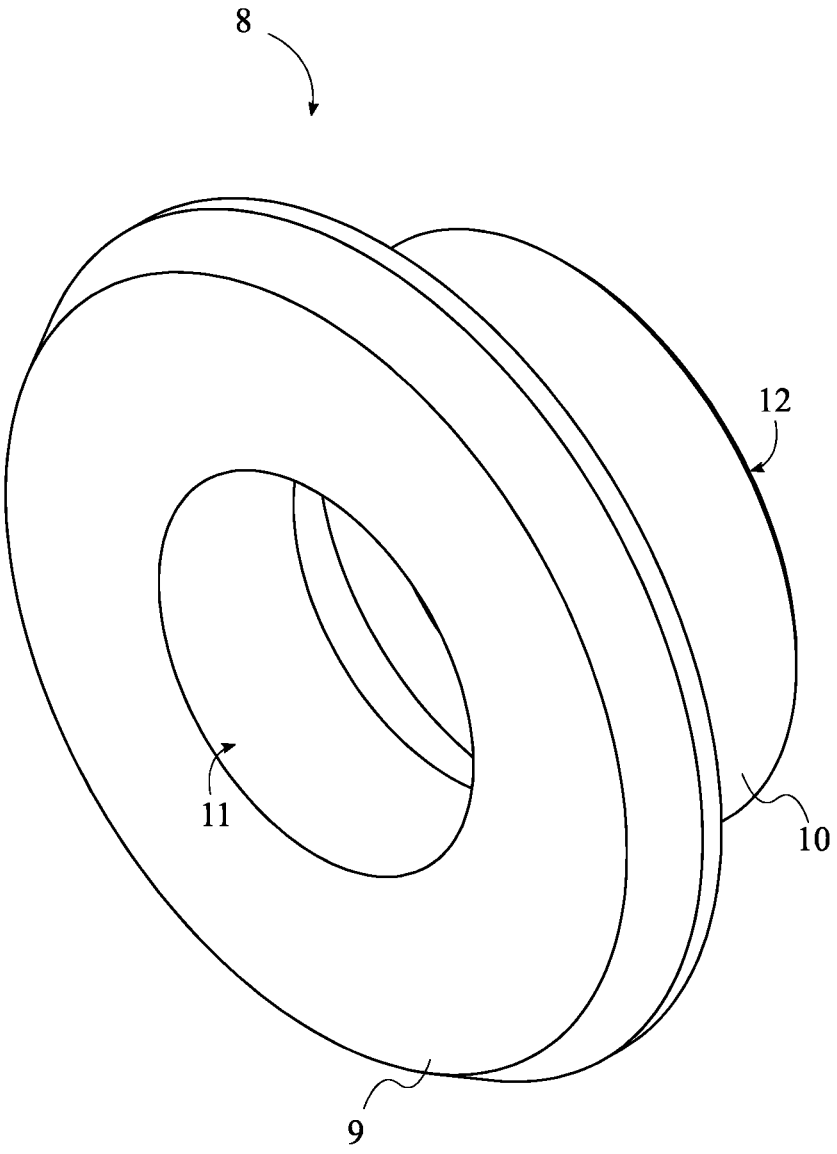
FIG. 16 is a top front perspective view of the flange adaptor of the present invention.
Figure 17:
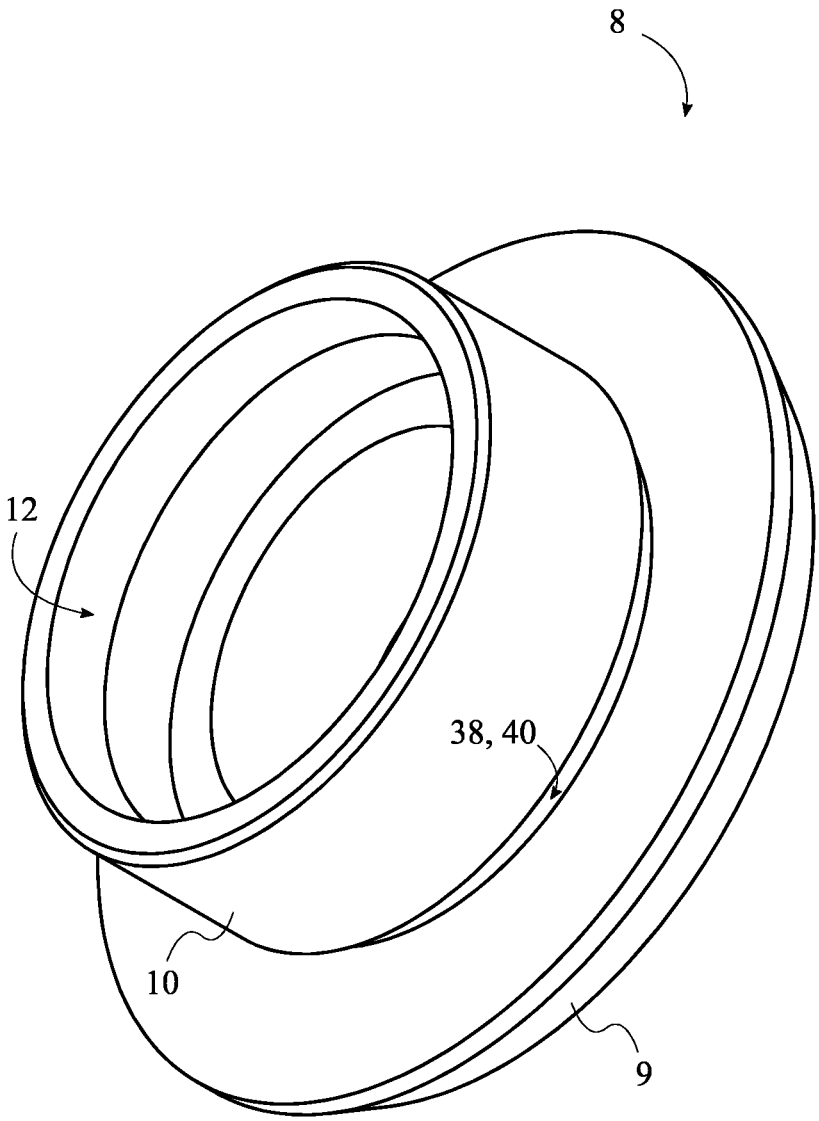
FIG. 17 is a bottom rear perspective view of the flange adaptor of the present invention.
Figure 18:
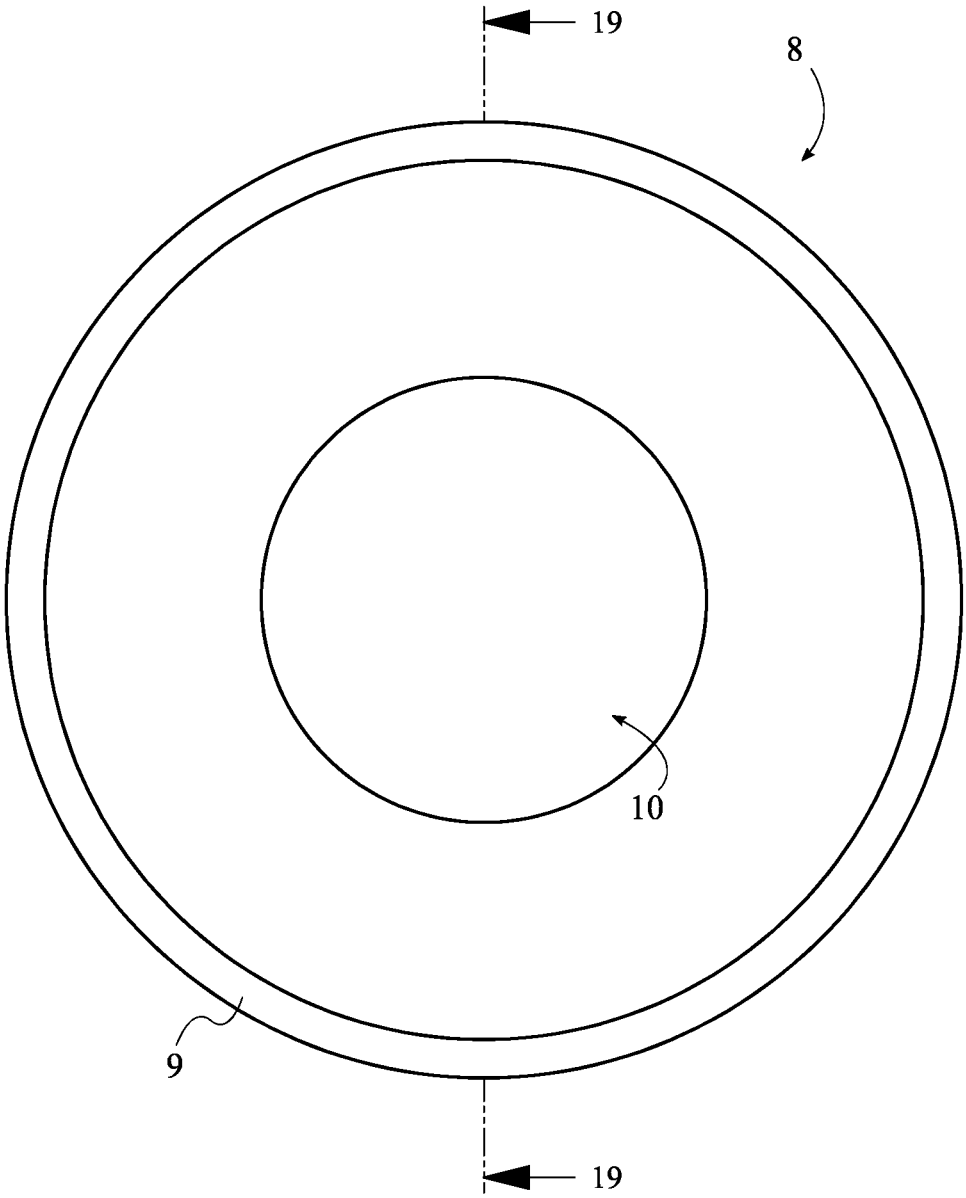
FIG. 18 is a front view of the flange adaptor of the present invention.
Figure 19:
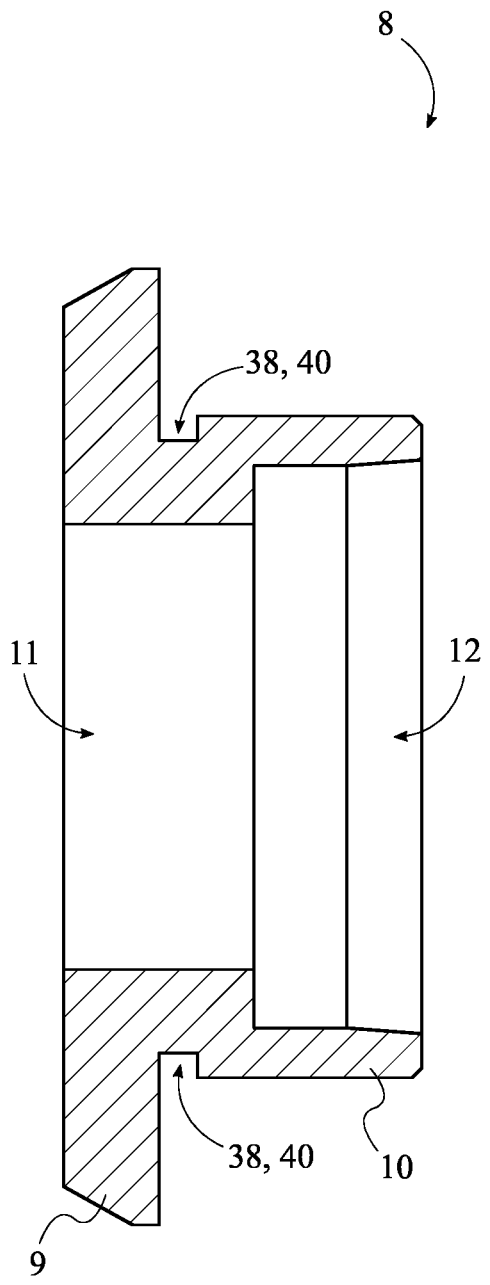
FIG. 19 is a vertical cross-sectional view taken in the direction of line 19-19 in FIG. 18.

As can be seen in FIGS. 4 through 7 and 16 through 19, the flange adaptor 8 is preferably designed to snuggly fit within the recoil housing 2. So, the flange adaptor 8 may comprise an adaptor flange 9, a first adaptor body 10, and a first adaptor hole 11, and a second adaptor hole 12. The adaptor flange 9 is a thin disc with an outer diameter matching the inner diameter of the housing lateral wall 6. The first adaptor body 10 is a short cylindrical structure with an outer diameter that is smaller than the outer diameter of the adaptor flange 9. To form the flange adaptor 8, the first adaptor body 10 is terminally connected to the adaptor flange 9. In addition, the adaptor flange 9, the first adaptor hole 11, and the second adaptor hole 12 are positioned concentric with the first adaptor body 10. This way, the first adaptor body 10 forms a T-shape structure with the adaptor flange 9. Further, the first adaptor hole 11 traverses through the first adaptor body 10 and the adaptor flange 9 to enable the projectile to pass through the flange adaptor 8 once fired. On the other hand, the second adaptor hole 12 traverses into the first adaptor body 10 so that both the three-lug adaptor 34 and the second spring 31 can be positioned within the first adaptor body 10. Finally, the adaptor flange 9 is positioned adjacent to the threaded protrusion 3 so that the first adaptor body 10 is oriented towards the housing opening 7. In other embodiments, the flange adaptor 8 can be modified to guide additional moving components within the recoil housing 2.

As can be seen in FIG. 4 through 9, due to the short length of the first adaptor body 10, only portions of the first spring 28 surround the first adaptor body 10. So, the first spring 28 may comprise a first proximal end 29 and a first distal end 30 corresponding to the terminal ends of the first spring 28. The first proximal end 29 is preferably positioned adjacent to the flange adaptor 8, while the first distal end 30 is positioned adjacent to the housing opening 7. This way, the first spring 28 spans the space between the adaptor flange 9 and the open cap 15 within the recoil housing 2, ensuring that the flange adaptor 8 is returned to the original position after every firing of the gun. In a similar fashion, only portions of the second spring 31 are positioned within the first adaptor body 10. So, the second spring 31 may comprise a second proximal end 32 and a second distal end 33 corresponding to the terminal ends of the second spring 31. The second proximal end 32 is preferably positioned within the second adaptor hole 12, while the second distal end 33 is positioned adjacent to the coupling 13. This way, the second spring 31 also spans the length of the knobbed bushing 19 to ensure that the coupling 13 stays in position within the knobbed bushing 19. In other embodiments, different spring mechanisms can be used to replace the first spring 28 and/or the second spring 31.

Figure 24:
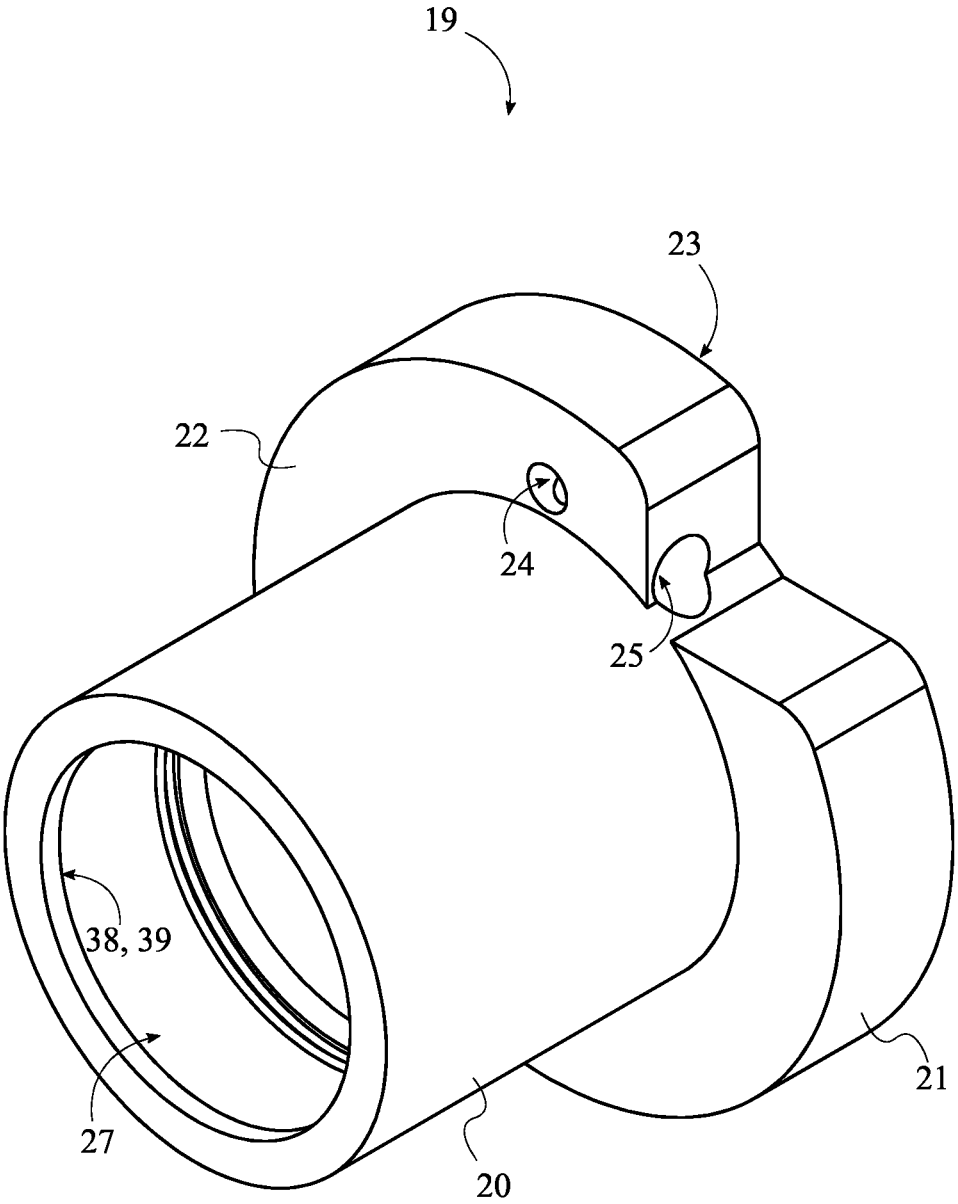
FIG. 24 is a top front perspective view of the knobbed bushing of the present invention.
Figure 25:
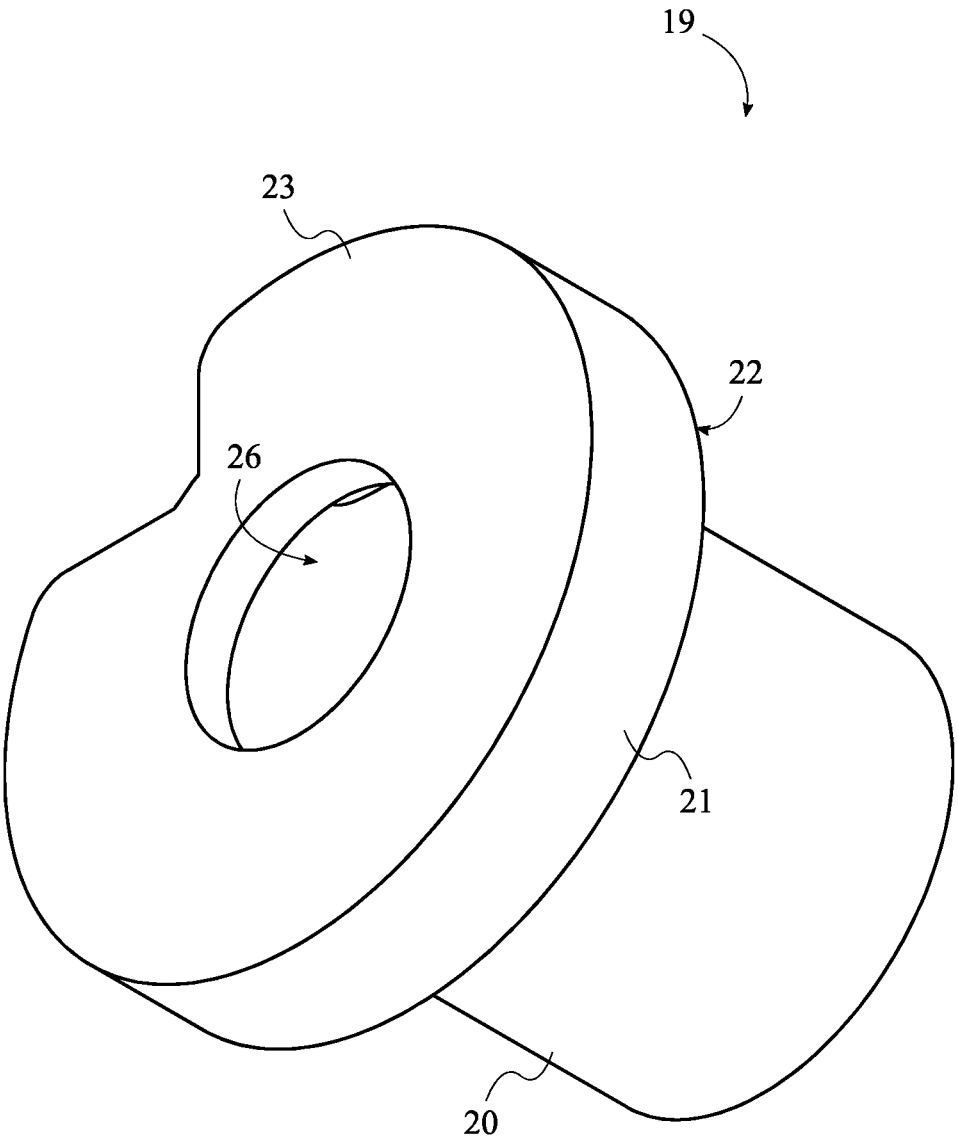
FIG. 25 is a bottom rear perspective view of the knobbed bushing of the present invention.
Figure 26:
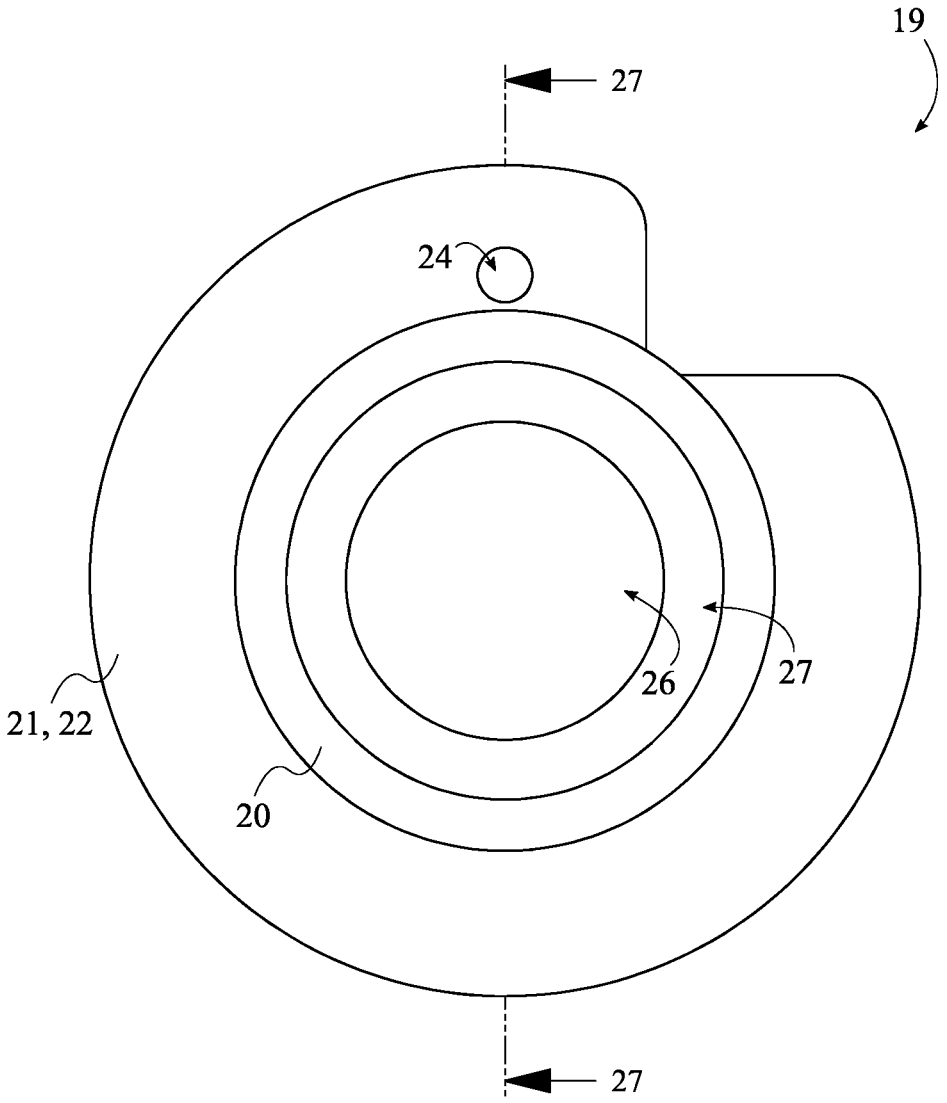
FIG. 26 is a front view of the knobbed bushing of the present invention.
Figure 27:
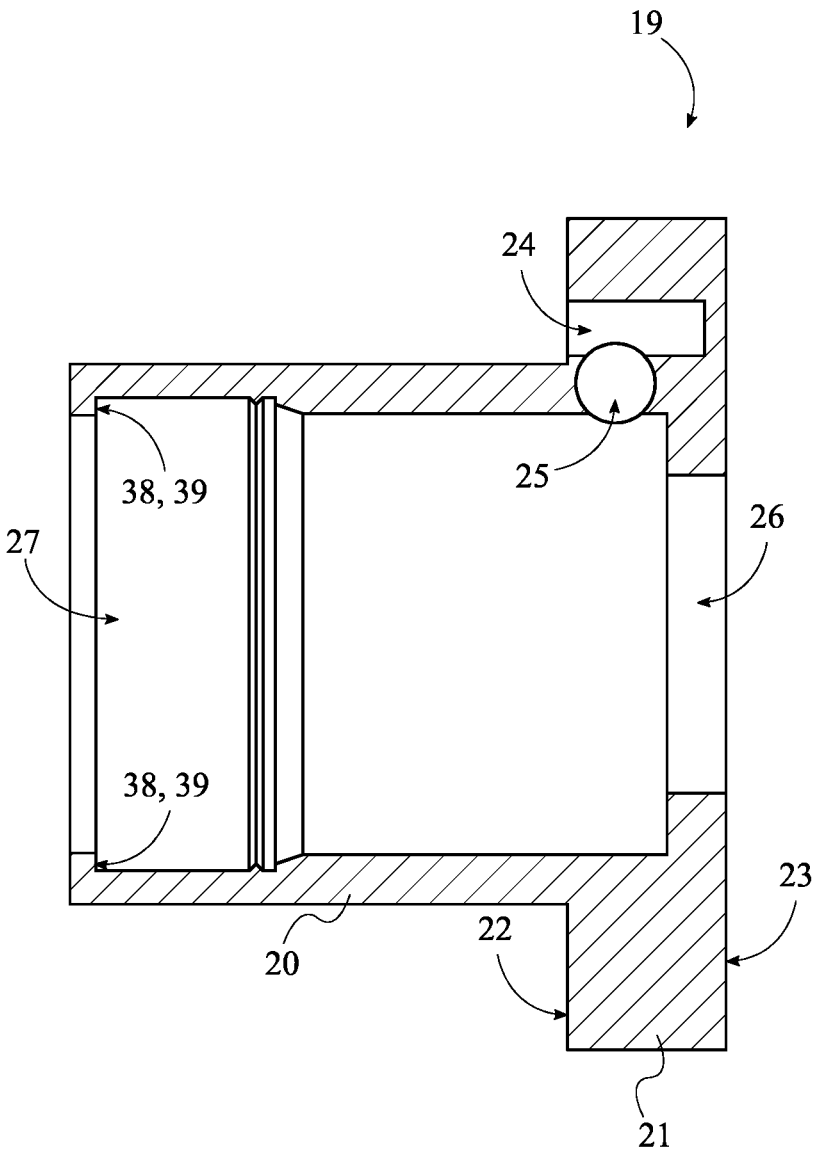
FIG. 27 is a vertical cross-sectional view taken in the direction of line 27-27 in FIG. 26.
Figure 28:
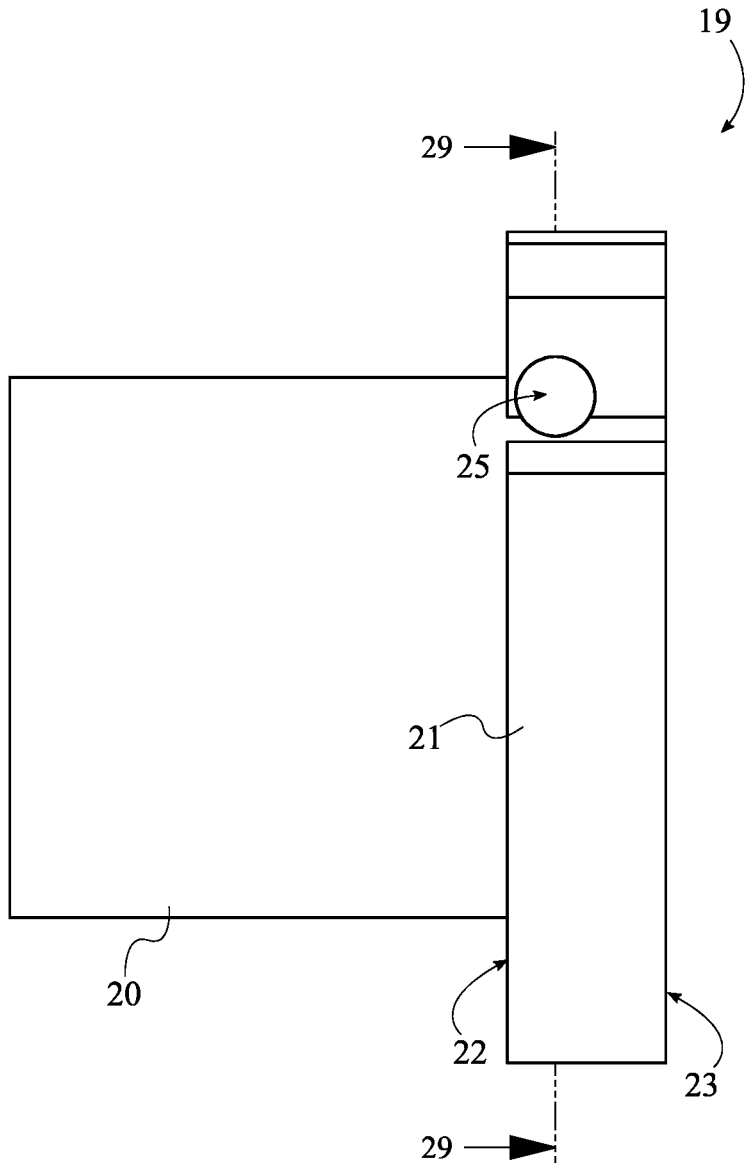
FIG. 28 is a side view of the knobbed bushing of the present invention.
Figure 29:
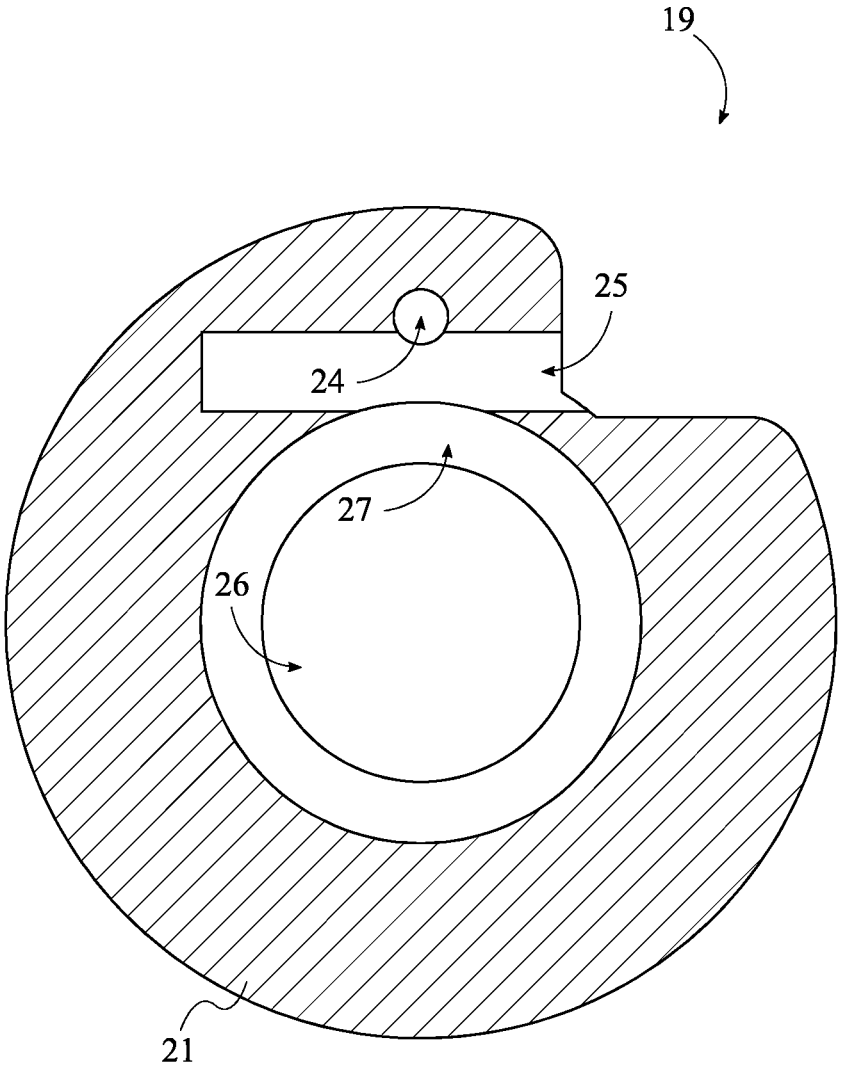
FIG. 29 is a vertical cross-sectional view taken in the direction of line 29-29 in FIG. 28.

As can be seen in FIGS. 4 through 7 and 24 through 29, the knobbed bushing 19 is designed to accommodate the three-lug adaptor 34 as previously disclosed. To do so, the knobbed bushing 19 may comprise a bushing body 20, a bushing flange 21, a first bushing hole 26, and a second bushing hole 27. Similar to the adaptor flange 9, the bushing flange 21 is a thin disc with an outer diameter preferably matching the outer diameter of the open cap 15. The bushing body 20 is a cylindrical structure with a length preferably larger than the length of the first adaptor body 10. Further, the outer diameter of the bushing body 20 is preferably smaller than the inner diameter of the first spring 28 while the inner diameter of the bushing body 20 is larger than the outer diameter of the first adaptor body 10. To form the knobbed bushing 19, the bushing body 20 is terminally connected to the bushing flange 21. The bushing flange 21, the first bushing hole 26, and the second bushing hole 27 are positioned concentric with the bushing body 20. This way, the bushing body 20 forms a T-shaped structure with the bushing flange 21. Further, the first bushing hole 26 traverses through the bushing body 20 and the bushing flange 21 to enable the projectile to pass through the knobbed bushing 19. On the other hand, the second bushing hole 27 traverses into the bushing flange 21 through the bushing body 20 so that the coupling 13 is positioned within the bushing flange 21. In addition, the bushing flange 21 is positioned adjacent to the open cap 15, opposite to the recoil housing 2, to keep the bushing body 20 from going too deep into the recoil housing 2. Moreover, the second distal end 33 of the second spring 31 and the coupling 13 are positioned within the second bushing hole 27. The coupling 13 is preferably positioned adjacent to the bushing flange 21, while the second distal end 33 of the second spring 31 is positioned adjacent to the coupling 13, opposite to the bushing flange 21. Thus, to connect the three-lug adaptor 34 to the knobbed bushing 19, the three-lug adaptor 34 is inserted into the first bushing hole 26. The three-lug adaptor 34 is pushed into the second adaptor hole 12 until the three-lug adaptor 34 securely engages with the coupling 13. Once secured, the three-lug adaptor 34 remains within the knobbed bushing 19, thus connecting the recoil booster 1 to the desired gun.

As can be seen in FIGS. 4 through 7, 16 through 19, and 24 through 29, as previously discussed, the knobbed bushing 19 is engaged with the flange adaptor 8 so that the flange adaptor 8 moves along the knobbed bushing 19 when the gun is fired. To ensure a secure connection between the two, the present invention may further comprise a first interlocking mechanism 38 that enables the easy coupling 13 of the knobbed bushing 19 to the flange adaptor 8 for maintenance of the present invention. To do so, the first interlocking mechanism 38 may comprise a first male interlocking piece 39 and a first female interlocking piece 40. The first male interlocking piece 39 and the first female interlocking piece 40 are preferably snap fit components that can be engaged by pressing one against the other and can be disengaged by simply pulling one from the other. The first female interlocking piece 40 is externally integrated into the first adaptor body 10, preferably adjacent to the adaptor flange 9. On the other hand, the first male interlocking piece 39 is terminally connected onto the bushing body 20, opposite to the bushing flange 21. The first male interlocking piece 39 is preferably positioned within the second bushing hole 27 so that when the bushing body 20 is positioned over the first adaptor body 10, the first male interlocking piece 39 engages with the first female interlocking piece 40. In other embodiments, the first interlocking mechanism 38 may be replaced with other locking mechanisms.

Figure 30:
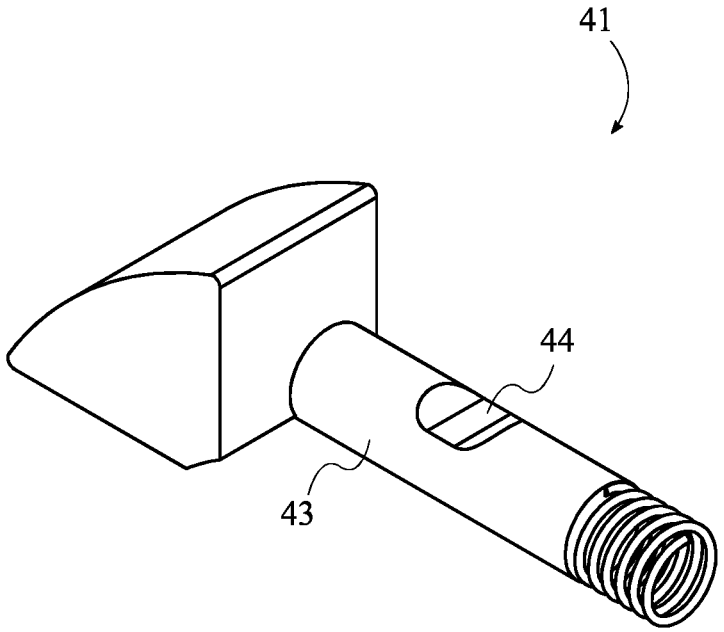
FIG. 30 is a top front perspective view of the spring-loaded pin of the attachment lock mechanism of the present invention.

When, the present invention is used with a tilting barrel gun, the forces applied to the recoil booster 1 and the three-lug adaptor 34 may cause the three-lug adaptor 34 to come loose. As can be seen in FIGS. 4 through 9 and 24 through 30, to prevent such risk, the present invention may further comprise an attachment lock mechanism 41 that further tightens the connection between the three-lug adaptor 34 and the coupling 13. To do so, the attachment lock mechanism 41 comprises a lock pin 42 and a spring-loaded pin 43. The lock pin 42 serves to lock the spring-loaded pin 43 into position, while the spring-loaded pin 43 serves to lock the connection between the three-lug adaptor 34 and the coupling 13. In addition, the bushing flange 21 comprises a first flange face 22, a second flange face 23, a first pin hole 24, and a second pin hole 25. The first flange face 22 and the second flange face 23 correspond to the flat faces of the disc shape of the bushing flange 21. The first pin hole 24 is designed to receive the lock pin 42, while the second pin hole 25 is designed to receive the spring-loaded pin 43. The first flange face 22 is preferably oriented towards the open cap 15, while the second flange face 23 is oriented away from the open cap 15.

Further, the first pin hole 24 is positioned geometrical normal to the first flange face 22. As can be seen in FIGS. 4 through 9 and 24 through 30, this ensures that the lock pin 42 stays within the first pin hole 24 when the recoil booter is assembled. The first pin hole 24 is positioned offset to the second bushing hole 27. In addition, the first pin hole 24 traverses into the bushing flange 21. This way, the cylindrical axis of the bushing body 20 and the axis of the first pin hole 24 are parallel to each other while maintaining the first pin hole 24 separate from the second bushing hole 27. On the other hand, the second pin hole 25 is positioned parallel to the first flange face 22. The second pin hole is also positioned adjacent to the first pin hole 24. The positioning of the second pin hole 25 is such that the second pin hole 25 traverses into the bushing flange 21 through the first pin hole 24 and the second bushing hole 27. Thus, to engage the attachment lock mechanism 41, the spring-loaded pin 43 is inserted into the second pin hole 25. The spring-loaded pin 43 can be pressed into the second pin hole 25 until the spring-loaded pin 43 is in contact with the coupling 13, which presses the coupling 13 against the three-lug attachment. The lock pin 42 is inserted into the first pin hole 24 to prevent the spring-loaded pin 43 from disengaging with the coupling 13. In some embodiments, the spring-loaded pin 43 may comprise a pin slot 44 that frictionally engages with the lock pin 42 until the user pulls the spring-loaded pin 43 out of the second pin hole 25 to release the coupling 13 from the three-lug attachment. The pin slot 44 is positioned adjacent to the first pin slot 44 so that once the spring-loaded pin 43 is pressed into the second pin hole 25, the lock pin 42 engages with the pin slot 44. Once the lock pin 42 is engaged with the pin slot 44, the spring-loaded pin 43 is frictionally engaged with the coupling 13. In other embodiments, the attachment lock mechanism 41 may utilize other means to further secure the connection between the coupling 13 and the three-lug attachment.

Figure 31:
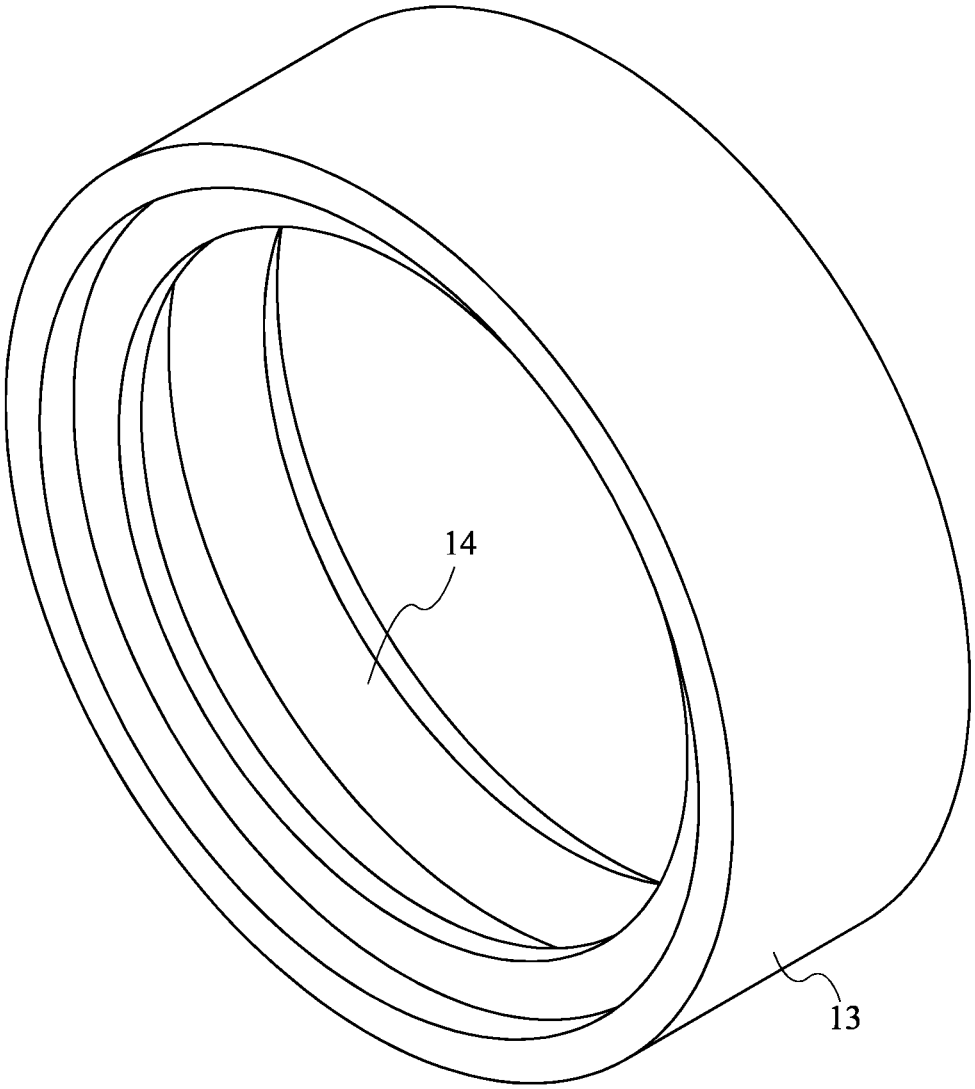
FIG. 31 is a top front perspective view of the coupling of the present invention.
Figure 32:
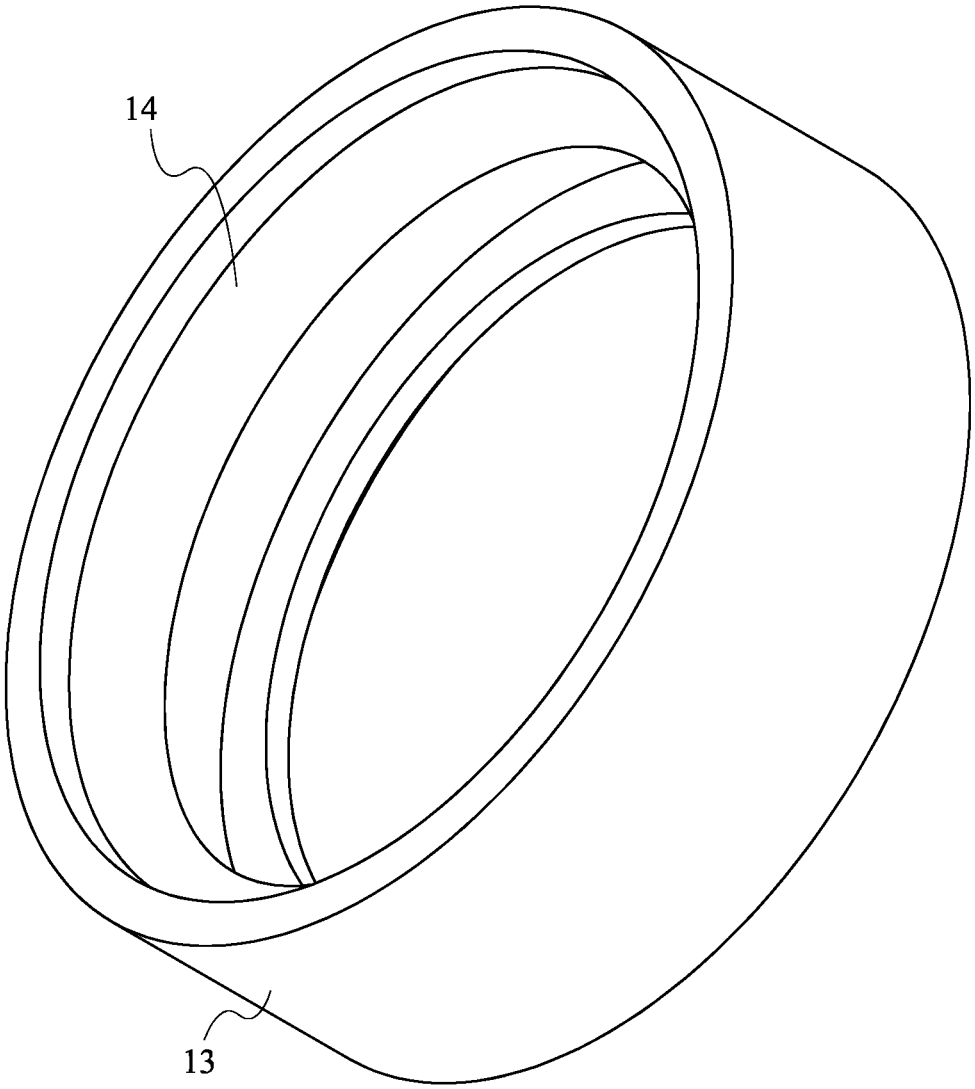
FIG. 32 is a bottom rear perspective view of the coupling of the present invention.
Figure 33:
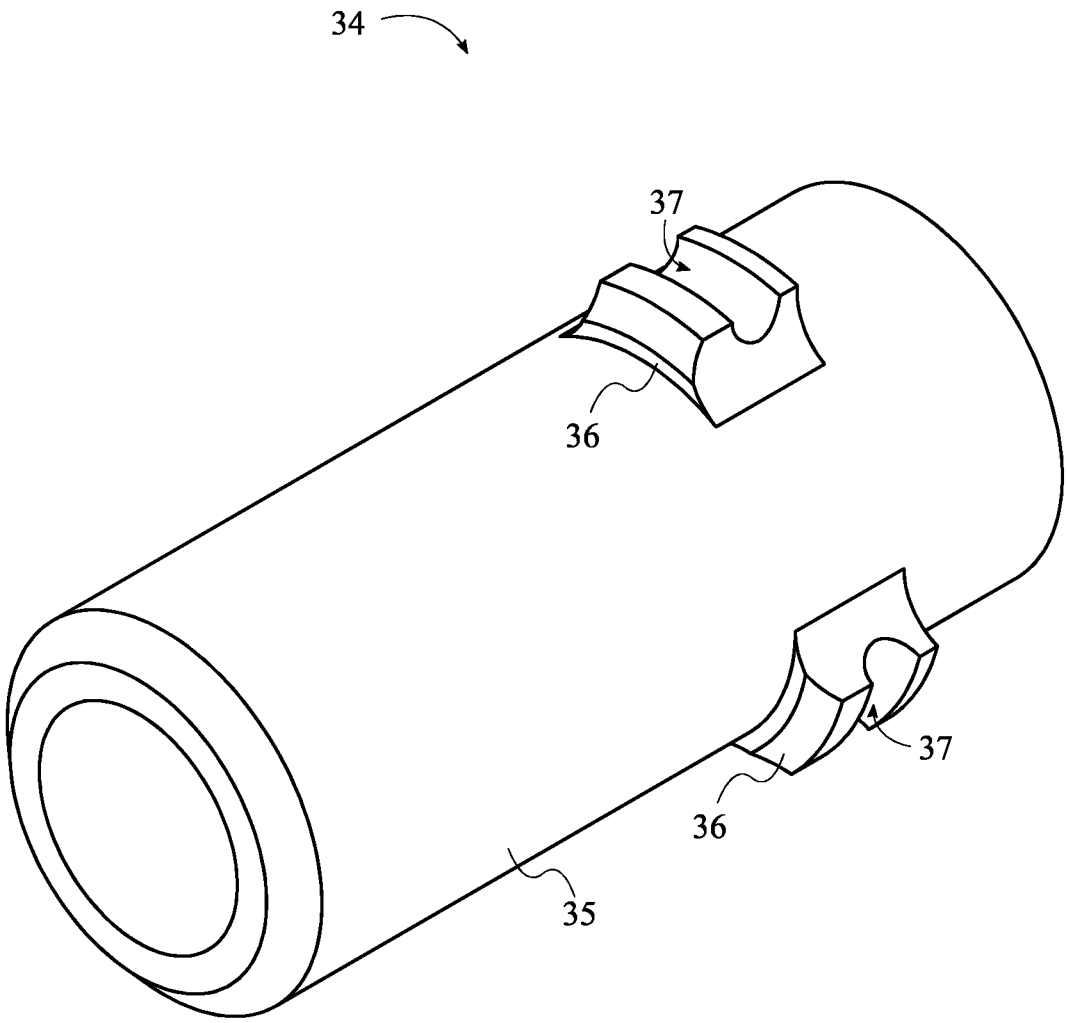
FIG. 33 is a top front perspective view of the three-lug adaptor of the present invention.
Figure 34:
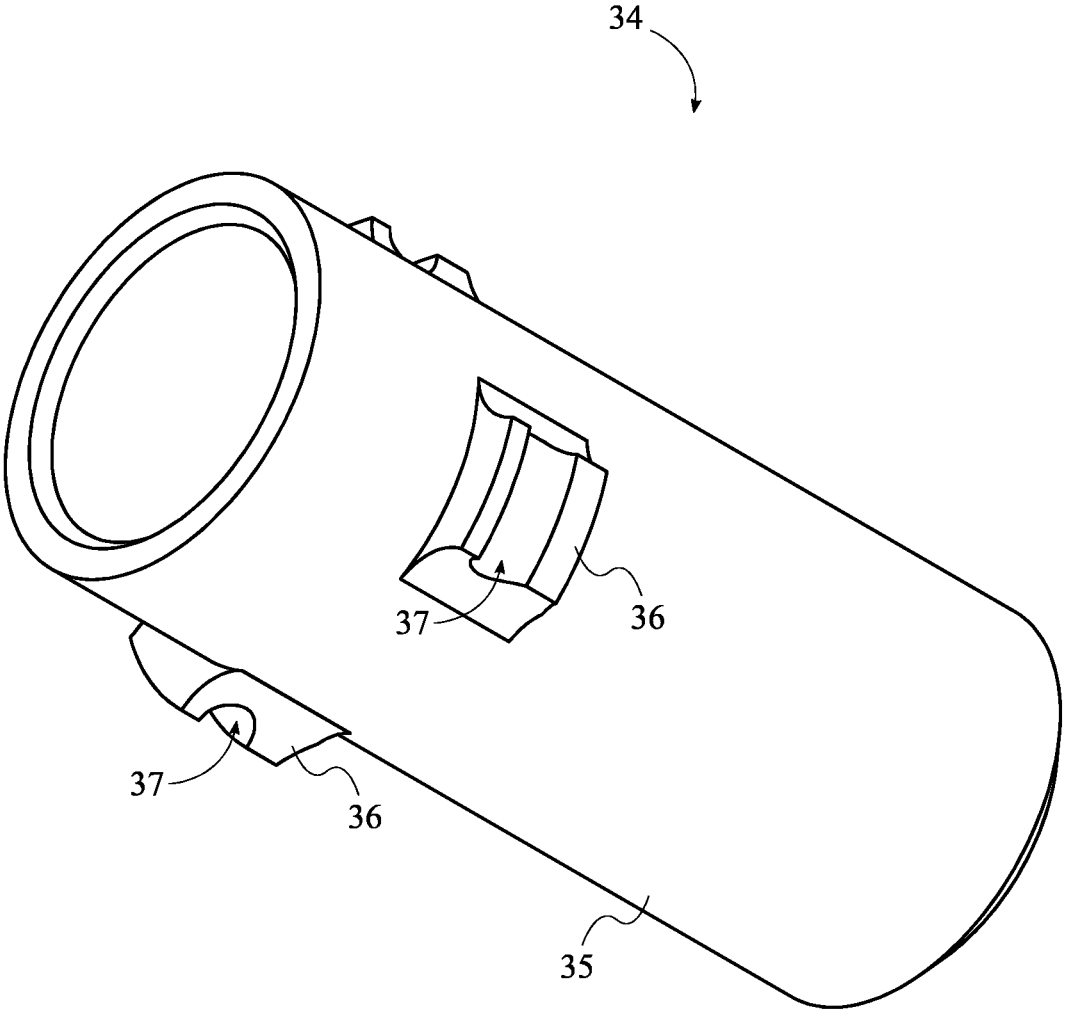
FIG. 34 is a bottom rear perspective view of the three-lug adaptor of the present invention.

As can be seen in FIGS. 4 through 7 and 31 through 34, as previously discussed, the coupling 13 facilitates the easy and quick connection between the recoil booster 1 and the three-lug attachment. To do so, the coupling 13 may comprise an inner ring 14. The three-lug adaptor 34 may also comprise a second adaptor body 35, a plurality of lugs 36, and a ring channel 37. The second adaptor body 35 is an elongated, hollow, and open-ended cylindrical structure. The plurality of lugs 36 includes several trapezoidal protrusions, preferably three, that engage with the coupling 13. The ring channel 37 is designed to match the inner ring 14 so that the three-lug adaptor 34 connects to the coupling 13. To do so, the inner ring 14 is positioned concentric to the coupling 13 and mounted within the coupling 13. The plurality of lugs 36 is radially distributed about the second adaptor body 35. In addition, the plurality of lugs 36 is externally and laterally mounted onto the second adaptor body 35 to form a single structure. The ring channel 37 is positioned concentric to the second adaptor body 35. The ring channel 37 also laterally traverses through the plurality of lugs 36. Thus, once the three-lug adaptor 34 is pushed into the first bushing hole 26, the second spring 31 pushes the coupling 13 against the plurality of lugs 36 until the inner ring 14 engages with the ring channel 37. In other embodiments, the coupling 13 may be modified to engage with different three-lug attachment designs.

Figure 20:
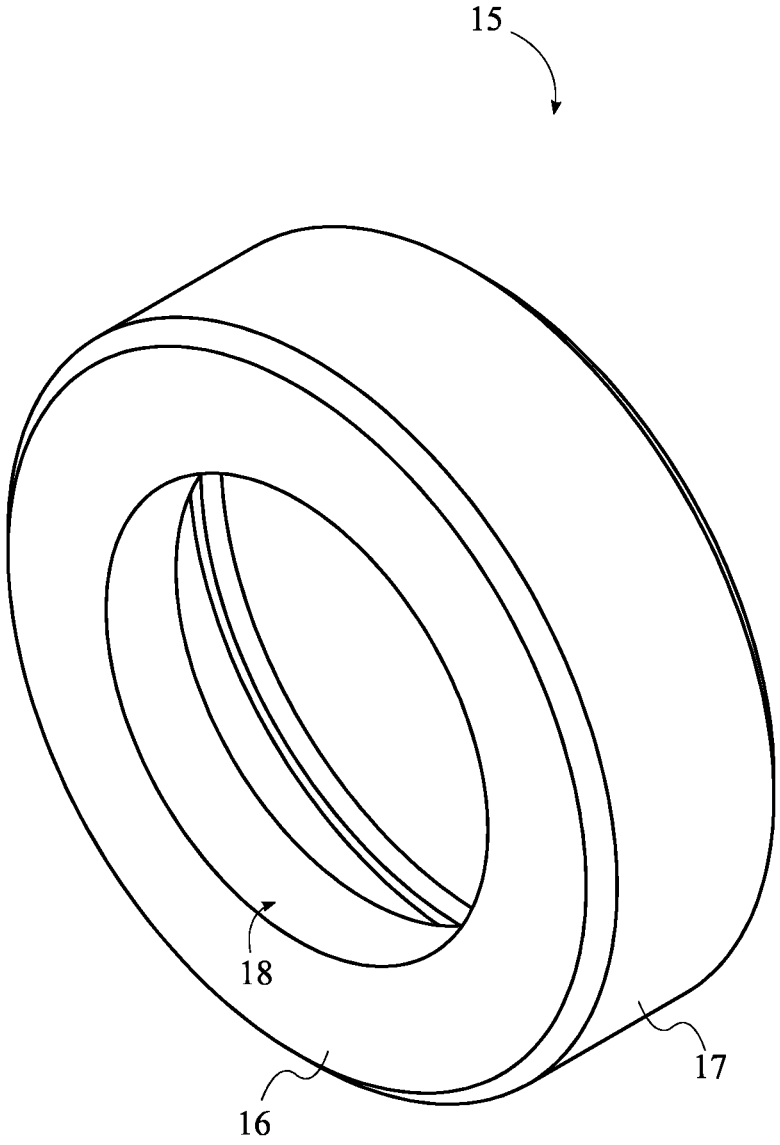
FIG. 20 is a top front perspective view of the open cap of the present invention.
Figure 21:
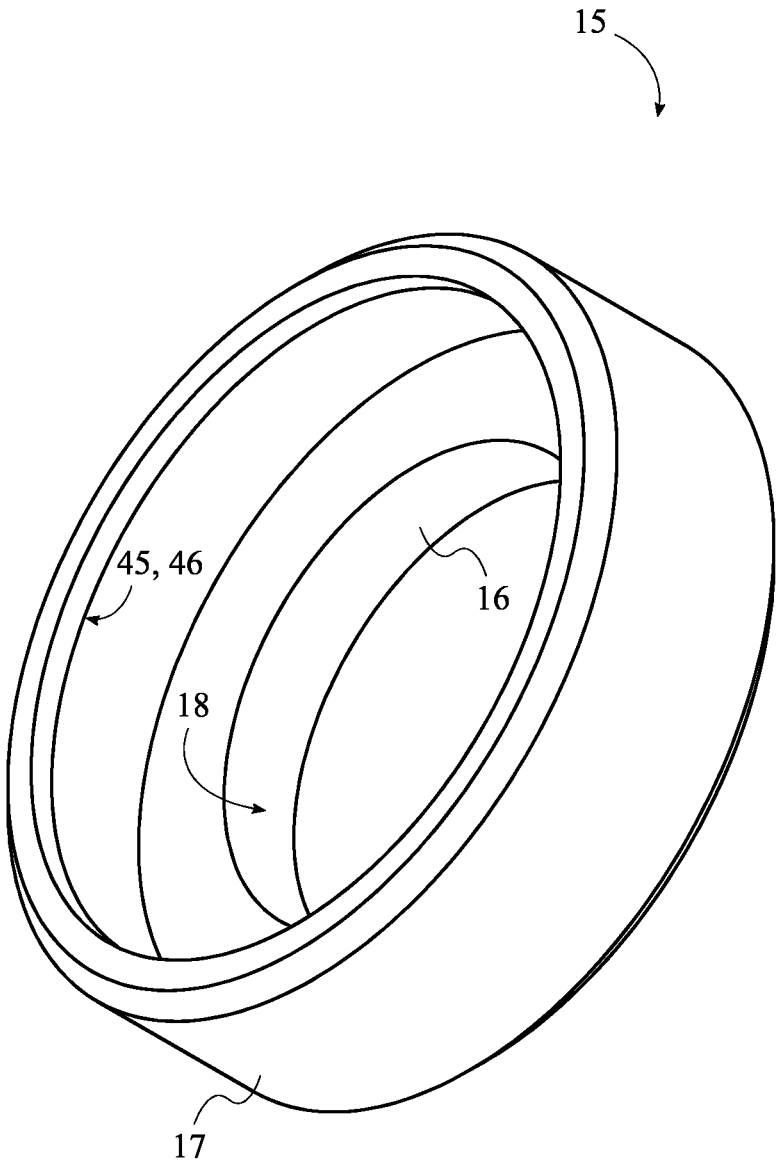
FIG. 21 is a bottom rear perspective view of the open cap of the present invention.
Figure 22:
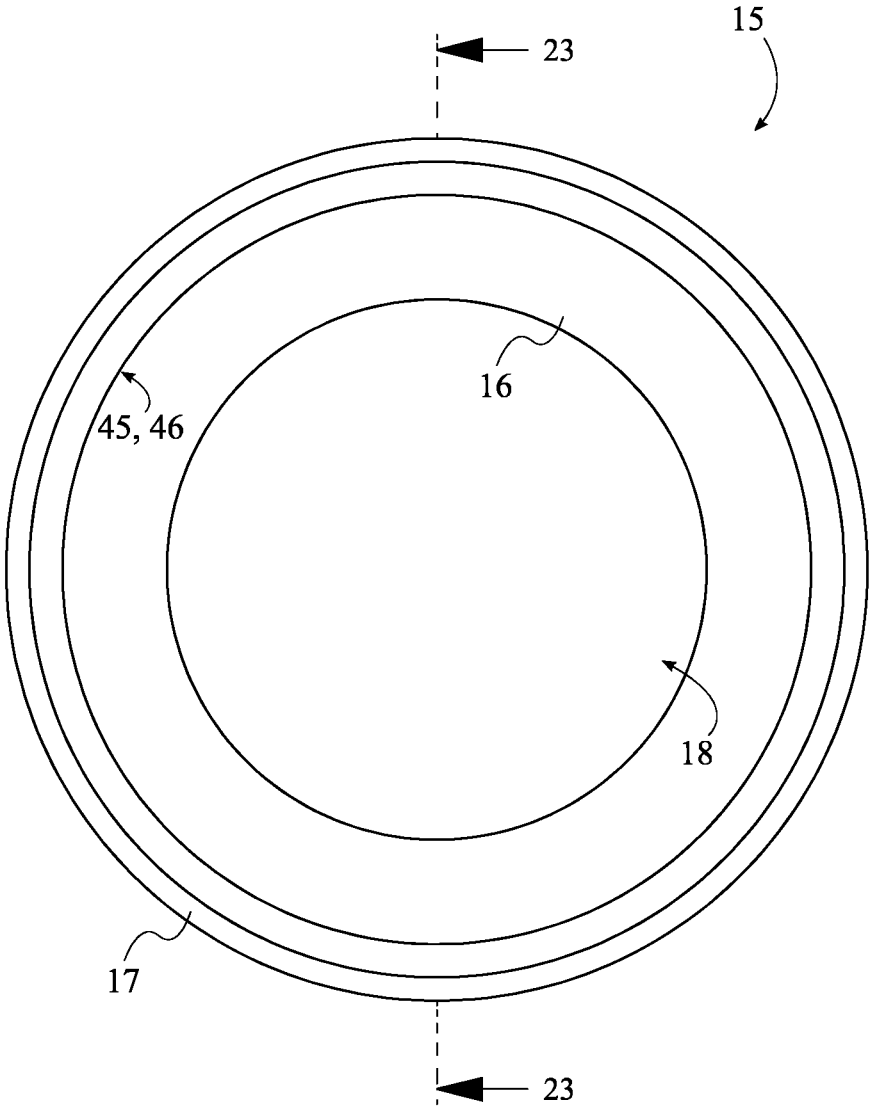
FIG. 22 is a rear view of the open cap of the present invention.
Figure 23:
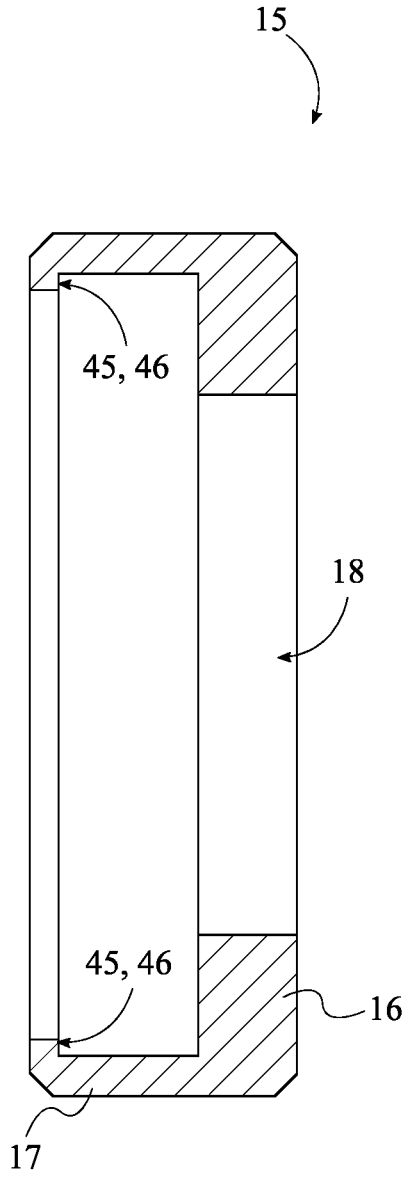
FIG. 23 is a vertical cross-sectional view taken in the direction of line 23-23 in FIG. 22.

Furthermore, the open cap 15 keeps the first spring 28 and the flange adaptor 8 within the recoil housing 2. As can be seen in FIGS. 4 through 7 and 20 through 23, to do so, the open cap 15 may comprise a cap base 16, a cap lateral wall 17, and a cap hole 18. The housing lateral wall 6 may also comprise a ring recession 52 to receive the open cap 15. The ring recession 52 is externally integrated into the housing lateral wall 6, adjacent to the housing opening 7, so that the open cap 15 can snuggly fit around the housing opening 7. The cap lateral wall 17 and the cap hole 18 are positioned concentric to the cap base 16 to form an overall short cylindrical structure. The cap base 16 preferably has an outer diameter matching the outer diameter of the housing lateral wall 6. The cap lateral wall 17 also has an outer diameter matching the outer diameter of the housing lateral wall 6, but an inner diameter matching the outer diameter of the ring recession 52. The cap base 16 is terminally connected to the cap lateral wall 17 to form a single structure. The cap hole 18 traverses through the cap base 16 to enable the knobbed bushing 19 to traverse into the first spring 28 through the cap hole 18. Then, to connect the open cap 15 to the housing opening 7, the cap lateral wall 17 is positioned coincident with the ring recession 52.

Similar to the knobbed bushing 19, the open cap 15 can be securely attached to the housing lateral wall 6 using an easy-to-use mechanism that enables quick attachment of the open cap 15 to the housing opening 7. As can be seen in FIGS. 4 through 7, 12 through 15, and 20 through 23, to do so, the present invention may further comprise a second interlocking mechanism 45. Like the first interlocking mechanism 38, the second interlocking mechanism 45 comprises a second male interlocking piece 46 and a second female interlocking piece 47 that correspond to two interlocking pieces that snap fit together. To do so, the second female interlocking piece 47 is positioned adjacent to the housing opening 7 and externally integrated into the ring recession 52. On the other hand, the second male interlocking piece 46 is terminally connected onto the cap lateral wall 17, opposite to the cap base 16. The second male interlocking piece 46 is preferably positioned within the cap lateral wall 17 so that when the cap lateral wall 17 is positioned coincident with the ring recession 52, the second male interlocking piece 46 engages with the second female interlocking piece 47. In other embodiments, the second interlocking mechanism 45 can be replaced with other locking means.

Furthermore, the present invention enables the desired gun silencer to be connected to the recoil booster 1 in different ways using the threaded protrusion 3. As can be seen in FIGS. 1 through 8 and 12 through 15, to do so, the threaded protrusion 3 comprises a protrusion body 4 and a first protrusion hole 5. The protrusion body 4 is a short cylindrical structure that engages with the desired gun silencer via external threading or internal threading. The protrusion body 4 and the first protrusion hole 5 are positioned concentric to the housing lateral wall 6 to maintain an overall cylindrical and symmetrical structure. The first protrusion hole 5 traverses into the recoil housing 2 through the protrusion body 4 to allow the projectile to exit through the protrusion body 4. The external threading is externally integrated into the protrusion body 4 and distributed along the protrusion body 4. Similarly, the internal threading is internally integrated into the first protrusion hole 5 and distributed along the protrusion body 4.

Figure 10:
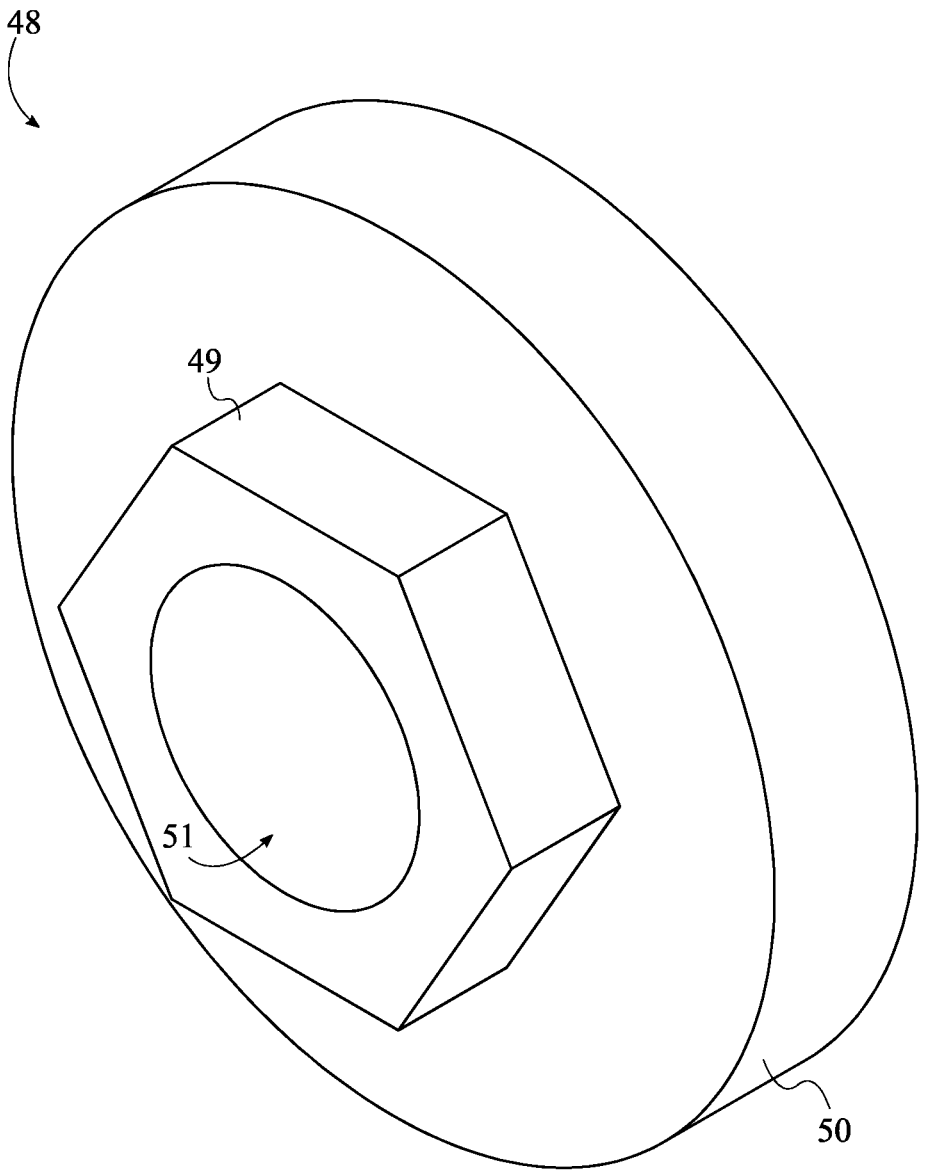
FIG. 10 is a top front perspective view of the thread adaptor of the present invention.
Figure 11:
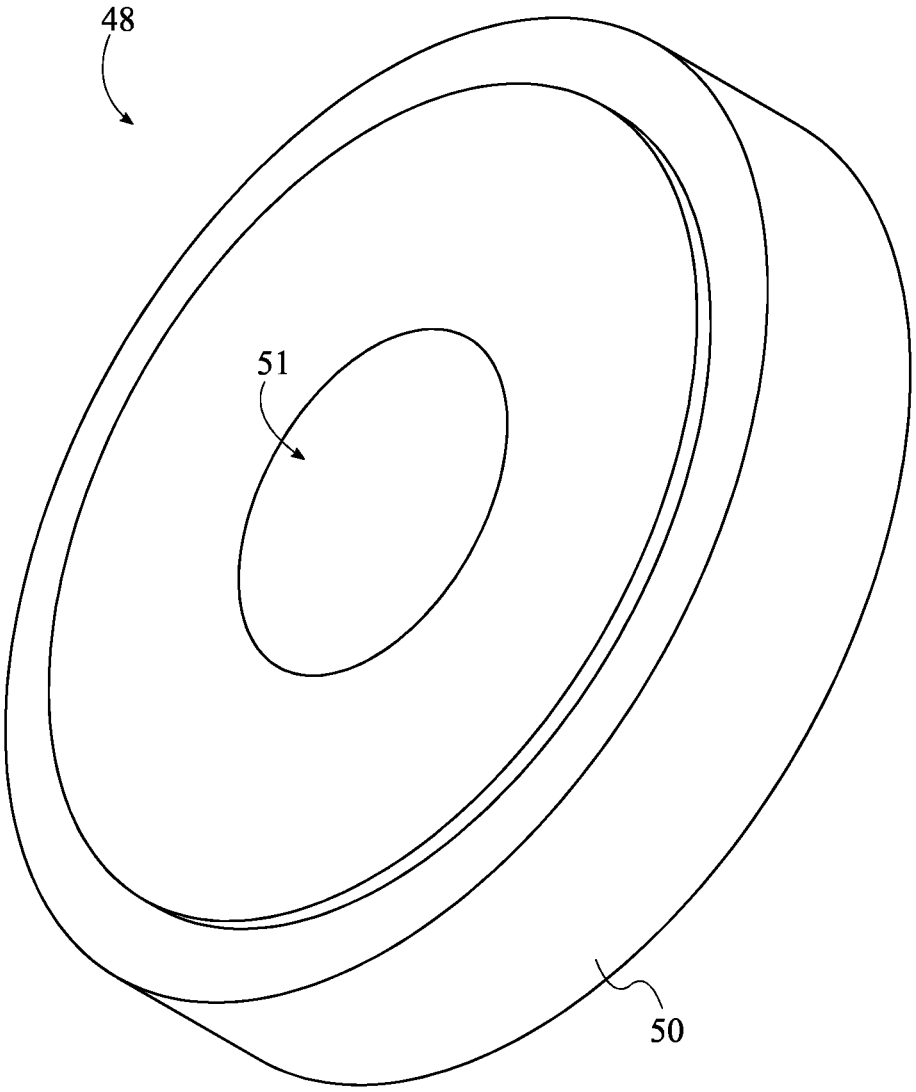
FIG. 11 is a bottom rear perspective view of the thread adaptor of the present invention.

For gun silencers that connect to the threaded protrusion 3 via the internal thread, the present invention may further comprise a thread adaptor 48. As can be seen in FIGS. 1 through 8, 10, and 11, the thread adaptor 48 helps securely connect a gun silencer with the internal thread of the threaded protrusion 3. To do so, the thread adaptor 48 comprises a hex nut 49, a third adaptor body 50, and a second protrusion hole 51. The hex nut 49 facilitates the attachment of the thread adaptor 48 to the thread protrusion. The hex nut 49 and the second protrusion hole 51 are positioned concentric to the third adaptor body 50 to form an overall short cylindrical structure. The third adaptor body 50 is terminally mounted onto the hex nut 49 to form a single structure. Further, the second protrusion hole 51 traverses through the hex nut 49 and the third adaptor body 50 to receive the threaded protrusion 3. The second protrusion hole 51 may also include internal threading that engages with the external threading on the protrusion body 4 to securely connect the thread adaptor 48 to the threaded protrusion 3. To connect the thread adaptor 48 to the threaded protrusion 3, the third adaptor body 50 is positioned adjacent to the recoil housing 2. Then, the third adaptor body 50 is threadably engaged with the protrusion body 4. In other embodiments, additional accessories may be provided to enable the use of the present invention with custom gun silencers.

Although the invention has been explained in relation to its preferred embodiment, it is to be understood that many other possible modifications and variations can be made without departing from the spirit and scope of the invention.

What is claimed is:

1. A fixed-to-tilted silencer adaptor for three-lug attachments comprising:

a recoil booster;

a three-lug adaptor;

the recoil booster comprising a recoil housing, a flange adaptor, a coupling, an open cap, a knobbed bushing, a first spring, and a second spring;

the recoil housing comprising a threaded protrusion, a housing lateral wall, and a housing opening;

the threaded protrusion being positioned opposite to the housing opening across the housing lateral wall;

the flange adaptor, the coupling, the open cap, the knobbed bushing, the first spring, the second spring, and the three-lug adaptor each being axially aligned with the recoil housing;

the flange adaptor being mounted within the recoil housing, adjacent to the threaded protrusion;

the first spring being positioned in between the flange adaptor and the housing lateral wall;

the first spring being mounted within the recoil housing;

the open cap being terminally connected to the housing opening;

the coupling being mounted within the knobbed bushing;

the second spring being mounted within the knobbed bushing, adjacent to the coupling;

the knobbed bushing traversing into the first spring through the open cap; and the three-lug adaptor traversing into the flange adaptor through the knobbed bushing, the coupling, and the second spring.

2. The fixed-to-tilted silencer adaptor for three-lug attachments as claimed in claim 1 comprising:

the flange adaptor comprising an adaptor flange, a first adaptor body, and a first adaptor hole, and a second adaptor hole;

the first adaptor body being terminally connected to the adaptor flange;

the adaptor flange, the first adaptor hole, and the second adaptor hole being positioned concentric with the first adaptor body;

the first adaptor hole traversing through the first adaptor body and the adaptor flange;

the second adaptor hole traversing into the first adaptor body; and the adaptor flange being positioned adjacent to the threaded protrusion.

3. The fixed-to-tilted silencer adaptor for three-lug attachments as claimed in claim 2 comprising:

the first spring comprising a first proximal end and a first distal end;

the first proximal end being positioned adjacent to the flange adaptor; and the first distal end being positioned adjacent to the housing opening.

4. The fixed-to-tilted silencer adaptor for three-lug attachments as claimed in claim 2 comprising:

the second spring comprising a second proximal end and a second distal end;

the second proximal end being positioned within the second adaptor hole; and the second distal end being positioned adjacent to the coupling.

5. The fixed-to-tilted silencer adaptor for three-lug attachments as claimed in claim 1 comprising:

the knobbed bushing comprising a bushing body, a bushing flange, a first bushing hole, and a second bushing hole;

the bushing body being terminally connected to the bushing flange;

the bushing flange, the first bushing hole, and the second bushing hole being positioned concentric with the bushing body;

the first bushing hole traversing through the bushing body and the bushing flange;

the second bushing hole traversing into the bushing flange through the bushing body;

the bushing flange being positioned adjacent to the open cap, opposite to the recoil housing;

the second spring and the coupling being positioned within the second bushing hole;

the coupling being positioned adjacent to the bushing flange; and the second spring being positioned adjacent to the coupling, opposite to the bushing flange.

6. The fixed-to-tilted silencer adaptor for three-lug attachments as claimed in claim comprising:

a first interlocking mechanism;

the first interlocking mechanism comprising a first male interlocking piece and a first female interlocking piece;

the flange adaptor comprising a first adaptor body;

the first female interlocking piece being externally integrated into the first adaptor body;

the first male interlocking piece being terminally connected onto the bushing body, opposite to the bushing flange; and the first male interlocking piece being engaged with the first female interlocking piece.

7. The fixed-to-tilted silencer adaptor for three-lug attachments as claimed in claim 5 comprising:

an attachment lock mechanism;

the attachment lock mechanism comprising a lock pin and a spring-loaded pin;

the bushing flange comprising a first flange face, a second flange face, a first pin hole, and a second pin hole;

the first flange face being oriented towards the open cap;

the second flange face being oriented away from the open cap;

the first pin hole being positioned geometrical normal to the first flange face;

the first pin hole being positioned offset to the second bushing hole;

the first pin hole traversing into the bushing flange;

the second pin hole being positioned parallel to the first flange face;

the second pin hole being positioned adjacent to the first pin hole;

the second pin hole traversing into the bushing flange through the first pin hole and the second bushing hole;

the spring-loaded pin being inserted into the second pin hole; and the lock pin being inserted into the first pin hole.

8. The fixed-to-tilted silencer adaptor for three-lug attachments as claimed in claim 7 comprising:

the spring-loaded pin comprising a pin slot;

the pin slot being positioned adjacent to the first pin slot;

the lock pin being engaged with the pin slot; and the spring-loaded pin being frictionally engaged with the coupling.

9. The fixed-to-tilted silencer adaptor for three-lug attachments as claimed in claim 1 comprising:

the coupling comprising an inner ring;

the three-lug adaptor comprising a second adaptor body, a plurality of lugs, and a ring channel;

the inner ring being positioned concentric to the coupling;

the inner ring being mounted within the coupling;

the plurality of lugs being radially distributed about the second adaptor body;

the plurality of lugs being externally and laterally mounted onto the second adaptor body;

the ring channel being positioned concentric to the second adaptor body;

the ring channel laterally traversing through the plurality of lugs; and the inner ring being engaged with the ring channel.

10. The fixed-to-tilted silencer adaptor for three-lug attachments as claimed in claim 1 comprising:

the open cap comprising a cap base, a cap lateral wall, and a cap hole;

the housing lateral wall comprising a ring recession;

the ring recession being externally integrated into the housing lateral wall, adjacent to the housing opening;

the cap lateral wall and the cap hole being positioned concentric to the cap base;

and the cap base being terminally connected to the cap lateral wall;

the cap hole traversing through the cap base;

the knobbed bushing traversing into the first spring through the cap hole;

the cap lateral wall being positioned coincident with the ring recession.

11. The fixed-to-tilted silencer adaptor for three-lug attachments as claimed in claim comprising:

a second interlocking mechanism;

the second interlocking mechanism comprising a second male interlocking piece and a second female interlocking piece;

the second female interlocking piece being positioned adjacent to the housing opening;

the second female interlocking piece being externally integrated into the ring recession;

the second male interlocking piece being terminally connected onto the cap lateral wall, opposite to the cap base; and the second male interlocking piece being engaged with the second female interlocking piece.

12. The fixed-to-tilted silencer adaptor for three-lug attachments as claimed in claim 1 comprising:

the threaded protrusion comprising a protrusion body and a first protrusion hole;

the protrusion body and the first protrusion hole being positioned concentric to the housing lateral wall; and the first protrusion hole traversing into the recoil housing through the protrusion body.

13. The fixed-to-tilted silencer adaptor for three-lug attachments as claimed in claim 12 comprising:

a thread adaptor;

the thread adaptor comprising a hex nut, a third adaptor body, and a second protrusion hole;

the hex nut and the second protrusion hole being positioned concentric to the third adaptor body;

the third adaptor body being terminally mounted onto the hex nut;

the second protrusion hole traversing through the hex nut and the third adaptor body;

the third adaptor body being positioned adjacent to the recoil housing; and the third adaptor body being threadably engaged with the protrusion body.

14. A fixed-to-tilted silencer adaptor for three-lug attachments comprising:

a recoil booster;

a three-lug adaptor;

the recoil booster comprising a recoil housing, a flange adaptor, a coupling, an open cap, a knobbed bushing, a first spring, and a second spring;

the recoil housing comprising a threaded protrusion, a housing lateral wall, and a housing opening;

the coupling comprising an inner ring;

the three-lug adaptor comprising a second adaptor body, a plurality of lugs, and a ring channel;

the threaded protrusion being positioned opposite to the housing opening across the housing lateral wall;

the flange adaptor, the coupling, the open cap, the knobbed bushing, the first spring, the second spring, and the three-lug adaptor each being axially aligned with the recoil housing;

the flange adaptor being mounted within the recoil housing, adjacent to the threaded protrusion;

the first spring being positioned in between the flange adaptor and the housing lateral wall;

the first spring being mounted within the recoil housing;

the open cap being terminally connected to the housing opening;

the coupling being mounted within the knobbed bushing;

the second spring being mounted within the knobbed bushing, adjacent to the coupling;

the knobbed bushing traversing into the first spring through the open cap;

the three-lug adaptor traversing into the flange adaptor through the knobbed bushing, the coupling, and the second spring;

the inner ring being positioned concentric to the coupling;

the inner ring being mounted within the coupling;

the plurality of lugs being radially distributed about the second adaptor body;

the plurality of lugs being externally and laterally mounted onto the second adaptor body;

the ring channel being positioned concentric to the second adaptor body;

the ring channel laterally traversing through the plurality of lugs; and the inner ring being engaged with the ring channel.

15. The fixed-to-tilted silencer adaptor for three-lug attachments as claimed in claim 14 comprising:

the flange adaptor comprising an adaptor flange, a first adaptor body, and a first adaptor hole, and a second adaptor hole;

the first adaptor body being terminally connected to the adaptor flange;

the adaptor flange, the first adaptor hole, and the second adaptor hole being positioned concentric with the first adaptor body;

the first adaptor hole traversing through the first adaptor body and the adaptor flange;

the second adaptor hole traversing into the first adaptor body; and the adaptor flange being positioned adjacent to the threaded protrusion.

16. The fixed-to-tilted silencer adaptor for three-lug attachments as claimed in claim 15 comprising:

the first spring comprising a first proximal end and a first distal end;

the second spring comprising a second proximal end and a second distal end;

the first proximal end being positioned adjacent to the flange adaptor;

the first distal end being positioned adjacent to the housing opening;

the second proximal end being positioned within the second adaptor hole; and the second distal end being positioned adjacent to the coupling.

17. The fixed-to-tilted silencer adaptor for three-lug attachments as claimed in claim 14 comprising:

a first interlocking mechanism;

the knobbed bushing comprising a bushing body, a bushing flange, a first bushing hole, and a second bushing hole;

the first interlocking mechanism comprising a first male interlocking piece and a first female interlocking piece;

the flange adaptor comprising a first adaptor body;

the bushing body being terminally connected to the bushing flange;

the bushing flange, the first bushing hole, and the second bushing hole being positioned concentric with the bushing body;

the first bushing hole traversing through the bushing body and the bushing flange;

the second bushing hole traversing into the bushing flange through the bushing body;

the bushing flange being positioned adjacent to the open cap, opposite to the recoil housing;

the second spring and the coupling being positioned within the second bushing hole;

the coupling being positioned adjacent to the bushing flange;

the second spring being positioned adjacent to the coupling, opposite to the bushing flange;

the first female interlocking piece being externally integrated into the first adaptor body;

the first male interlocking piece being terminally connected onto the bushing body, opposite to the bushing flange; and the first male interlocking piece being engaged with the first female interlocking piece.

18. The fixed-to-tilted silencer adaptor for three-lug attachments as claimed in claim 17 comprising:

an attachment lock mechanism;

the attachment lock mechanism comprising a lock pin and a spring-loaded pin;

the bushing flange comprising a first flange face, a second flange face, a first pin hole, and a second pin hole;

the spring-loaded pin comprising a pin slot;

the first flange face being oriented towards the open cap;

the second flange face being oriented away from the open cap;

the first pin hole being positioned geometrical normal to the first flange face;

the first pin hole being positioned offset to the second bushing hole;

the first pin hole traversing into the bushing flange;

the second pin hole being positioned parallel to the first flange face;

the second pin hole being positioned adjacent to the first pin hole;

the second pin hole traversing into the bushing flange through the first pin hole and the second bushing hole;

the spring-loaded pin being inserted into the second pin hole;

the lock pin being inserted into the first pin hole;

the pin slot being positioned adjacent to the first pin slot;

the lock pin being engaged with the pin slot; and the spring-loaded pin being frictionally engaged with the coupling.

19. The fixed-to-tilted silencer adaptor for three-lug attachments as claimed in claim 14 comprising:

a second interlocking mechanism;

the open cap comprising a cap base, a cap lateral wall, and a cap hole;

the second interlocking mechanism comprising a second male interlocking piece and a second female interlocking piece;

the housing lateral wall comprising a ring recession;

the ring recession being externally integrated into the housing lateral wall, adjacent to the housing opening;

the cap lateral wall and the cap hole being positioned concentric to the cap base;

the cap base being terminally connected to the cap lateral wall;

the cap hole traversing through the cap base;

the knobbed bushing traversing into the first spring through the cap hole;

the cap lateral wall being positioned coincident with the ring recession;

the second female interlocking piece being positioned adjacent to the housing opening;

the second female interlocking piece being externally integrated into the ring recession;

the second male interlocking piece being terminally connected onto the cap lateral wall, opposite to the cap base; and the second male interlocking piece being engaged with the second female interlocking piece.

20. The fixed-to-tilted silencer adaptor for three-lug attachments as claimed in claim 14 comprising:

a thread adaptor;

the threaded protrusion comprising a protrusion body and a first protrusion hole;

the thread adaptor comprising a hex nut, a third adaptor body, and a second protrusion hole;

the protrusion body and the first protrusion hole being positioned concentric to the housing lateral wall;

the first protrusion hole traversing into the recoil housing through the protrusion body;

the hex nut and the second protrusion hole being positioned concentric to the third adaptor body;

the third adaptor body being terminally mounted onto the hex nut;

the second protrusion hole traversing through the hex nut and the third adaptor body;

the third adaptor body being positioned adjacent to the recoil housing; and the third adaptor body being threadably engaged with the protrusion body.

* * * * *